US006987510B2

(12) United States Patent
Iwami et al.

(10) Patent No.: US 6,987,510 B2
(45) Date of Patent: Jan. 17, 2006

(54) DISPLAY PANEL DRIVER

(75) Inventors: Takashi Iwami, Yamanashi-ken (JP); Toyohisa Yuasa, Yamanashi-ken (JP); Takashi Okushima, Yamanashi-ken (JP); Tetsuya Shigeta, Yamanashi-ken (JP); Tetsuro Nagakubo, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 335 days.

(21) Appl. No.: 10/603,616

(22) Filed: Jun. 26, 2003

(65) Prior Publication Data

US 2004/0004610 A1 Jan. 8, 2004

(30) Foreign Application Priority Data

Jun. 27, 2002 (JP) ..... 2002-188286

(51) Int. Cl.
*G09G 5/00* (2006.01)

(52) U.S. Cl. ..... 345/211; 345/204; 345/210; 345/212; 345/214

(58) Field of Classification Search ..... 345/55, 345/60, 67, 68, 80, 92–96, 204, 208–215; 315/169.1, 169.4
See application file for complete search history.

(56) References Cited

U.S. PATENT DOCUMENTS

| | | | | |
|---|---|---|---|---|
| 6,072,447 | A * | 6/2000 | Noborio | 345/60 |
| 6,304,038 | B1 * | 10/2001 | Ide et al. | 315/169.1 |
| 6,333,738 | B1 * | 12/2001 | Ide | 345/211 |
| 6,337,763 | B1 * | 1/2002 | Berkey et al. | 359/337.2 |
| 2003/0184537 | A1 * | 10/2003 | Nagaoka | 345/204 |

* cited by examiner

*Primary Examiner*—Vijay Shankar
(74) *Attorney, Agent, or Firm*—Sughrue Mion, PLLC

(57) ABSTRACT

It is an object of the present invention to provide a display panel driver with which power consumption can be reduced. The display panel driver includes a pixel data pulse generation circuit which generates pixel data pulses by connecting the column electrodes and a power source line in accordance with the pixel data to apply the pixel data pulses to the column electrodes, and a resonance pulse power circuit which generates a resonance pulse power source voltage to apply the resonance pulse power source voltage to the power source line, the resonance pulse power circuit changing the resonance amplitude of the resonance pulse power source voltage while keeping a maximum voltage of the resonance pulse power source voltage in accordance with a pattern of a pulse sequence of the pixel data pulses. A predicted power consumption of the resonance pulse power circuit is determined based on the pixel data for one field, and the pixel data pulse generation circuit is controlled so as to adjust the power consumption of the resonance pulse power circuit in accordance with the predicted power consumption.

10 Claims, 16 Drawing Sheets

FIG. 4

(SELECTIVE ERASURE)

| GRADATION | CONVERSION TABLE OF SECOND DATA CONVERSION CIRCUIT 34 | | | | | | | | | | | | | | | LIGHT-EMISSION DRIVING PATTERN FOR ONE FIELD | | | | | | | | | | | | | | EMITTED LUMINANCE |
|---|---|---|---|---|---|---|---|---|---|---|---|---|---|---|---|---|---|---|---|---|---|---|---|---|---|---|---|---|---|---|
| | PDs | GDa | | | | | | | | | | | | | | SF | SF | SF | SF | SF | SF | SF | SF | SF | SF | SF | SF | SF | SF | |
| | | 1 | 2 | 3 | 4 | 5 | 6 | 7 | 8 | 9 | 10 | 11 | 12 | 13 | 14 | 1 | 2 | 3 | 4 | 5 | 6 | 7 | 8 | 9 | 10 | 11 | 12 | 13 | 14 | |
| 1 | 0000 | 1 | 1 | 1 | 1 | 1 | 1 | 1 | 1 | 1 | 1 | 1 | 1 | 1 | 1 | ● | ● | ● | ● | ● | ● | ● | ● | ● | ● | ● | ● | ● | ● | 0 |
| 2 | 0001 | 0 | 1 | 1 | 1 | 1 | 1 | 1 | 1 | 1 | 1 | 1 | 1 | 1 | 1 | ○ | ● | ● | ● | ● | ● | ● | ● | ● | ● | ● | ● | ● | ● | 4 |
| 3 | 0010 | 0 | 0 | 1 | 1 | 1 | 1 | 1 | 1 | 1 | 1 | 1 | 1 | 1 | 1 | ○ | ○ | ● | ● | ● | ● | ● | ● | ● | ● | ● | ● | ● | ● | 16 |
| 4 | 0011 | 0 | 0 | 0 | 1 | 1 | 1 | 1 | 1 | 1 | 1 | 1 | 1 | 1 | 1 | ○ | ○ | ○ | ● | ● | ● | ● | ● | ● | ● | ● | ● | ● | ● | 36 |
| 5 | 0100 | 0 | 0 | 0 | 0 | 1 | 1 | 1 | 1 | 1 | 1 | 1 | 1 | 1 | 1 | ○ | ○ | ○ | ○ | ● | ● | ● | ● | ● | ● | ● | ● | ● | ● | 68 |
| 6 | 0101 | 0 | 0 | 0 | 0 | 0 | 1 | 1 | 1 | 1 | 1 | 1 | 1 | 1 | 1 | ○ | ○ | ○ | ○ | ○ | ● | ● | ● | ● | ● | ● | ● | ● | ● | 108 |
| 7 | 0110 | 0 | 0 | 0 | 0 | 0 | 0 | 1 | 1 | 1 | 1 | 1 | 1 | 1 | 1 | ○ | ○ | ○ | ○ | ○ | ○ | ● | ● | ● | ● | ● | ● | ● | ● | 160 |
| 8 | 0111 | 0 | 0 | 0 | 0 | 0 | 0 | 0 | 1 | 1 | 1 | 1 | 1 | 1 | 1 | ○ | ○ | ○ | ○ | ○ | ○ | ○ | ● | ● | ● | ● | ● | ● | ● | 224 |
| 9 | 1000 | 0 | 0 | 0 | 0 | 0 | 0 | 0 | 0 | 1 | 1 | 1 | 1 | 1 | 1 | ○ | ○ | ○ | ○ | ○ | ○ | ○ | ○ | ● | ● | ● | ● | ● | ● | 300 |
| 10 | 1001 | 0 | 0 | 0 | 0 | 0 | 0 | 0 | 0 | 0 | 1 | 1 | 1 | 1 | 1 | ○ | ○ | ○ | ○ | ○ | ○ | ○ | ○ | ○ | ● | ● | ● | ● | ● | 388 |
| 11 | 1010 | 0 | 0 | 0 | 0 | 0 | 0 | 0 | 0 | 0 | 0 | 1 | 1 | 1 | 1 | ○ | ○ | ○ | ○ | ○ | ○ | ○ | ○ | ○ | ○ | ● | ● | ● | ● | 488 |
| 12 | 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ● | ● | 600 |
| 13 | 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 728 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 868 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 1024 |

BLACK CIRCLES: SELECTIVE ERASING DISCHARGE
WHITE CIRCLES: SUSTAINED DISCHARGE EMISSION

FIG. 5

(SELECTIVE ERASURE)

| GRADATION | CONVERSION TABLE OF SECOND DATA CONVERSION CIRCUIT 35 | | | | | | | | | | | | | | | LIGHT-EMISSION DRIVING PATTERN FOR ONE FIELD | | | | | | | | | | | | | | EMITTED LUMINANCE |
|---|---|---|---|---|---|---|---|---|---|---|---|---|---|---|---|---|---|---|---|---|---|---|---|---|---|---|---|---|---|---|
| | PDs | GDb | | | | | | | | | | | | | | SF | SF | SF | SF | SF | SF | SF | SF | SF | SF | SF | SF | SF | SF | |
| | | 1 | 2 | 3 | 4 | 5 | 6 | 7 | 8 | 9 | 10 | 11 | 12 | 13 | 14 | 1 | 2 | 3 | 4 | 5 | 6 | 7 | 8 | 9 | 10 | 11 | 12 | 13 | 14 | |
| 1 | 0000 | 1 | 0 | 0 | 0 | 0 | 0 | 0 | 0 | 0 | 0 | 0 | 0 | 0 | 0 | ● | | | | | | | | | | | | | | 0 |
| 2 | 0001 | 0 | 1 | 0 | 0 | 0 | 0 | 0 | 0 | 0 | 0 | 0 | 0 | 0 | 0 | ○ | ● | | | | | | | | | | | | | 4 |
| 3 | 0010 | 0 | 0 | 1 | 0 | 0 | 0 | 0 | 0 | 0 | 0 | 0 | 0 | 0 | 0 | ○ | ○ | ● | | | | | | | | | | | | 16 |
| 4 | 0011 | 0 | 0 | 0 | 1 | 0 | 0 | 0 | 0 | 0 | 0 | 0 | 0 | 0 | 0 | ○ | ○ | ○ | ● | | | | | | | | | | | 36 |
| 5 | 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 68 |
| 6 | 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 108 |
| 7 | 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 160 |
| 8 | 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 224 |
| 9 | 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 300 |
| 10 | 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 388 |
| 11 | 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 488 |
| 12 | 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 600 |
| 13 | 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 728 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 868 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 1024 |

BLACK CIRCLES: SELECTIVE ERASING DISCHARGE
WHITE CIRCLES: SUSTAINED DISCHARGE EMISSION

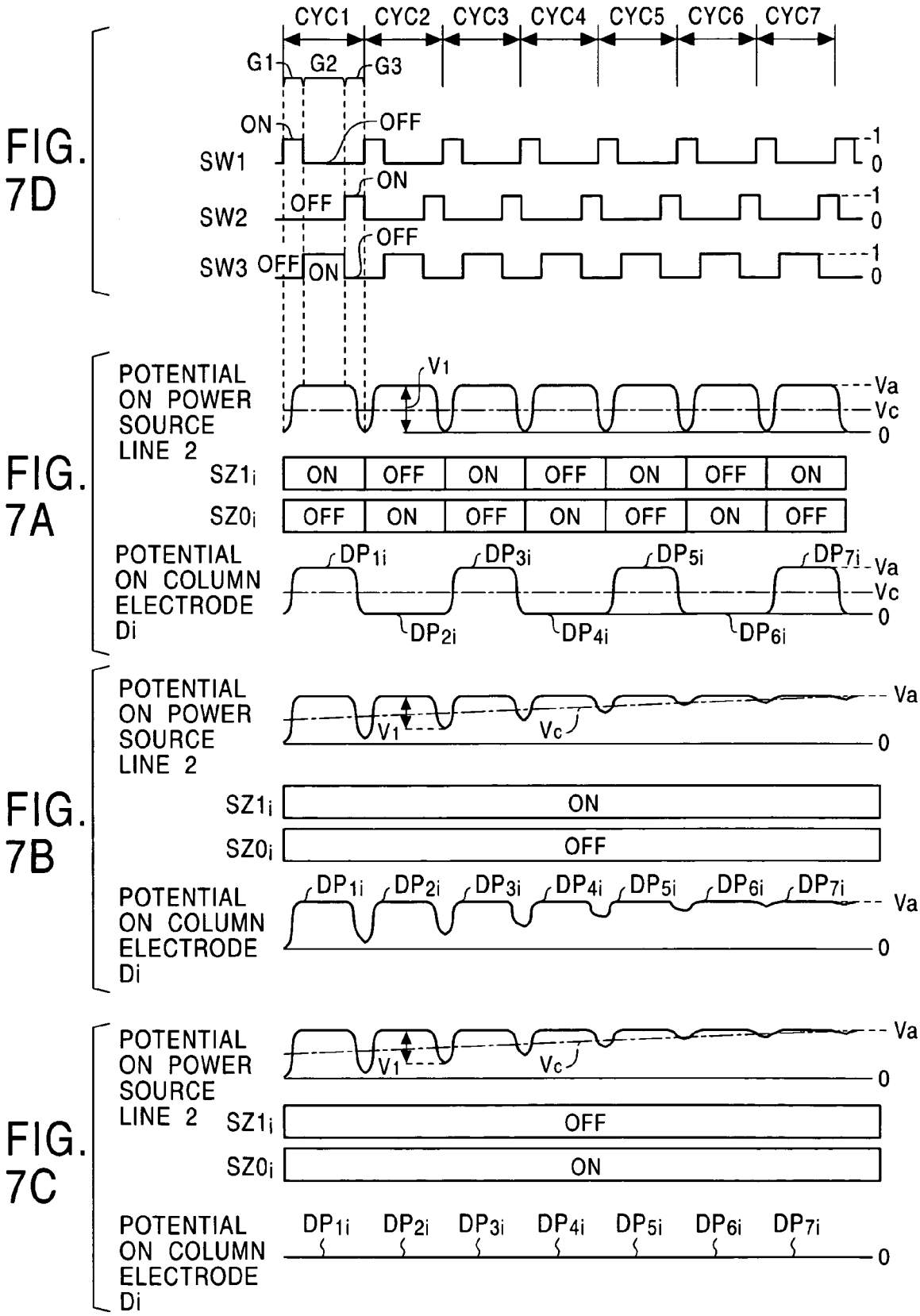
FIG. 7D
CYC1 CYC2 CYC3 CYC4 CYC5 CYC6 CYC7
G1 G2 G3
ON OFF
SW1
ON
OFF
SW2
OFF ON
SW3
1
0
FIG. 7A
POTENTIAL ON POWER SOURCE LINE 2
V1
Va
Vc
0
SZ1i ON OFF ON OFF ON OFF ON
SZ0i OFF ON OFF ON OFF ON OFF
POTENTIAL ON COLUMN ELECTRODE Di
DP1i DP2i DP3i DP4i DP5i DP6i DP7i
FIG. 7B
POTENTIAL ON POWER SOURCE LINE 2
V1 Vc
SZ1i ON
SZ0i OFF
POTENTIAL ON COLUMN ELECTRODE Di
DP1i DP2i DP3i DP4i DP5i DP6i DP7i
FIG. 7C
POTENTIAL ON POWER SOURCE LINE 2
V1 Vc
SZ1i OFF
SZ0i ON
POTENTIAL ON COLUMN ELECTRODE Di
DP1i DP2i DP3i DP4i DP5i DP6i DP7i

FIG. 9

$$DB_{(N,M)} = \begin{bmatrix} DB_{(1,1)} & DB_{(1,2)} & DB_{(1,3)} & \cdots\cdots & DB_{(1,m)} \\ DB_{(2,1)} & DB_{(2,2)} & DB_{(2,3)} & \cdots\cdots & DB_{(2,m)} \\ DB_{(3,1)} & DB_{(3,2)} & DB_{(3,3)} & \cdots\cdots & DB_{(3,m)} \\ \vdots & \vdots & \vdots & & \vdots \\ DB_{(n,1)} & DB_{(n,2)} & DB_{(n,3)} & \cdots\cdots & DB_{(n,m)} \end{bmatrix}$$

FIG. 13

(SELECTIVE WRITING)

| GRADATION | CONVERSION TABLE OF SECOND DATA CONVERSION CIRCUIT 34 | | | | | | | | | | | | | | LIGHT-EMISSION DRIVING PATTERN FOR ONE FIELD | | | | | | | | | | | | | | EMITTED LUMINANCE |
|---|---|---|---|---|---|---|---|---|---|---|---|---|---|---|---|---|---|---|---|---|---|---|---|---|---|---|---|---|---|
| | PDs | GDa | | | | | | | | | | | | | SF | SF | SF | SF | SF | SF | SF | SF | SF | SF | SF | SF | SF | SF | |
| | | 14 | 13 | 12 | 11 | 10 | 9 | 8 | 7 | 6 | 5 | 4 | 3 | 2 | 1 | 14 | 13 | 12 | 11 | 10 | 9 | 8 | 7 | 6 | 5 | 4 | 3 | 2 | 1 | |
| 1 | 0000 | 0 | 0 | 0 | 0 | 0 | 0 | 0 | 0 | 0 | 0 | 0 | 0 | 0 | 0 | | | | | | | | | | | | | | | 0 |
| 2 | 0001 | 0 | 0 | 0 | 0 | 0 | 0 | 0 | 0 | 0 | 0 | 0 | 0 | 0 | 1 | | | | | | | | | | | | | | △ | 4 |
| 3 | 0010 | 0 | 0 | 0 | 0 | 0 | 0 | 0 | 0 | 0 | 0 | 0 | 0 | 1 | 1 | | | | | | | | | | | | | △ | △ | 16 |
| 4 | 0011 | 0 | 0 | 0 | 0 | 0 | 0 | 0 | 0 | 0 | 0 | 0 | 1 | 1 | 1 | | | | | | | | | | | | △ | △ | △ | 36 |
| 5 | 0100 | 0 | 0 | 0 | 0 | 0 | 0 | 0 | 0 | 0 | 0 | 1 | 1 | 1 | 1 | | | | | | | | | | | △ | △ | △ | △ | 68 |
| 6 | 0101 | 0 | 0 | 0 | 0 | 0 | 0 | 0 | 0 | 0 | 1 | 1 | 1 | 1 | 1 | | | | | | | | | | △ | △ | △ | △ | △ | 108 |
| 7 | 0110 | 0 | 0 | 0 | 0 | 0 | 0 | 0 | 0 | 1 | 1 | 1 | 1 | 1 | 1 | | | | | | | | | △ | △ | △ | △ | △ | △ | 160 |
| 8 | 0111 | 0 | 0 | 0 | 0 | 0 | 0 | 0 | 1 | 1 | 1 | 1 | 1 | 1 | 1 | | | | | | | | △ | △ | △ | △ | △ | △ | △ | 224 |
| 9 | 1000 | 0 | 0 | 0 | 0 | 0 | 0 | 1 | 1 | 1 | 1 | 1 | 1 | 1 | 1 | | | | | | | △ | △ | △ | △ | △ | △ | △ | △ | 300 |
| 10 | 1001 | 0 | 0 | 0 | 0 | 0 | 1 | 1 | 1 | 1 | 1 | 1 | 1 | 1 | 1 | | | | | | △ | △ | △ | △ | △ | △ | △ | △ | △ | 388 |
| 11 | 1010 | 0 | 0 | 0 | 0 | 1 | 1 | 1 | 1 | 1 | 1 | 1 | 1 | 1 | 1 | | | | | △ | △ | △ | △ | △ | △ | △ | △ | △ | △ | 488 |
| 12 | 1011 | 0 | 0 | 0 | 1 | 1 | 1 | 1 | 1 | 1 | 1 | 1 | 1 | 1 | 1 | | | | △ | △ | △ | △ | △ | △ | △ | △ | △ | △ | △ | 600 |
| 13 | 1100 | 0 | 0 | 1 | 1 | 1 | 1 | 1 | 1 | 1 | 1 | 1 | 1 | 1 | 1 | | | △ | △ | △ | △ | △ | △ | △ | △ | △ | △ | △ | △ | 728 |
| 14 | 1101 | 0 | 1 | 1 | 1 | 1 | 1 | 1 | 1 | 1 | 1 | 1 | 1 | 1 | 1 | | △ | △ | △ | △ | △ | △ | △ | △ | △ | △ | △ | △ | △ | 868 |
| 15 | 1110 | 1 | 1 | 1 | 1 | 1 | 1 | 1 | 1 | 1 | 1 | 1 | 1 | 1 | 1 | △ | △ | △ | △ | △ | △ | △ | △ | △ | △ | △ | △ | △ | △ | 1024 |

WHITE TRIANGLE: SELECTIVE WRITING DISCHARGE + SUSTAINED DISCHARGE EMISSION

FIG. 14

(SELECTIVE WRITING)

| GRADATION | CONVERSION TABLE OF SECOND DATA CONVERSION CIRCUIT 35 | | | | | | | | | | | | | | | LIGHT-EMISSION DRIVING PATTERN FOR ONE FIELD | | | | | | | | | | | | | | EMITTED LUMINANCE |
|---|---|---|---|---|---|---|---|---|---|---|---|---|---|---|---|---|---|---|---|---|---|---|---|---|---|---|---|---|---|---|
| | PDs | GDb | | | | | | | | | | | | | | SF | SF | SF | SF | SF | SF | SF | SF | SF | SF | SF | SF | SF | SF | |
| | | 14 | 13 | 12 | 11 | 10 | 9 | 8 | 7 | 6 | 5 | 4 | 3 | 2 | 1 | 14 | 13 | 12 | 11 | 10 | 9 | 8 | 7 | 6 | 5 | 4 | 3 | 2 | 1 | |
| 1 | 0000 | 0 | 0 | 0 | 0 | 0 | 0 | 0 | 0 | 0 | 0 | 0 | 0 | 0 | 0 | | | | | | | | | | | | | | | 0 |
| 2 | 0001 | 0 | 0 | 0 | 0 | 0 | 0 | 0 | 0 | 0 | 0 | 0 | 0 | 0 | 1 | | | | | | | | | | | | | | ● | 4 |
| 3 | 0010 | 0 | 0 | 0 | 0 | 0 | 0 | 0 | 0 | 0 | 0 | 0 | 0 | 1 | 0 | | | | | | | | | | | | | ● | ○ | 16 |
| 4 | 0011 | 0 | 0 | 0 | 0 | 0 | 0 | 0 | 0 | 0 | 0 | 0 | 1 | 0 | 0 | | | | | | | | | | | | ● | ○ | ○ | 36 |
| 5 | 0100 | 0 | 0 | 0 | 0 | 0 | 0 | 0 | 0 | 0 | 0 | 1 | 0 | 0 | 0 | | | | | | | | | | | ● | ○ | ○ | ○ | 68 |
| 6 | 0101 | 0 | 0 | 0 | 0 | 0 | 0 | 0 | 0 | 0 | 1 | 0 | 0 | 0 | 0 | | | | | | | | | | ● | ○ | ○ | ○ | ○ | 108 |
| 7 | 0110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | 160 |
| 8 | 0111 | 0 | 0 | 0 | 0 | 0 | 0 | 0 | 1 | 0 | 0 | 0 | 0 | 0 | 0 | | | | | | | | ● | ○ | ○ | ○ | ○ | ○ | ○ | 224 |
| 9 | 1000 | 0 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | 300 |
| 10 | 1001 | 0 | 0 | 0 | 0 | 0 | 1 | 0 | 0 | 0 | 0 | 0 | 0 | 0 | 0 | | | | | | ● | ○ | ○ | ○ | ○ | ○ | ○ | ○ | ○ | 388 |
| 11 | 1010 | 0 | 0 | 0 | 0 | 1 | 0 | 0 | 0 | 0 | 0 | 0 | 0 | 0 | 0 | | | | | ● | ○ | ○ | ○ | ○ | ○ | ○ | ○ | ○ | ○ | 488 |
| 12 | 1011 | 0 | 0 | 0 | 1 | 0 | 0 | 0 | 0 | 0 | 0 | 0 | 0 | 0 | 0 | | | | ● | ○ | ○ | ○ | ○ | ○ | ○ | ○ | ○ | ○ | ○ | 600 |
| 13 | 1100 | 0 | 0 | 1 | 0 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | 728 |
| 14 | 1101 | 0 | 1 | 0 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | 868 |
| 15 | 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | 1024 |

BLACK CIRCLE: SELECTIVE WRITING DISCHARGE + SUSTAINED DISCHARGE EMISSION
WHITE CIRCLE: SUSTAINED DISCHARGE EMISSION

DISPLAY PANEL DRIVER

BACKGROUND OF THE INVENTION

1. Field of the Invention

The present invention relates to a display panel driver.

2. Description of the Related Art

In recent years, as the screens of display devices become larger, there is also a demand for thinner display devices, and various kinds of thin display devices have been put into practice. Plasma display panels (referred to in the following as "PDP") have garnered attention as one type of thin display panel in which a plurality of discharge cells serving as pixels are arranged in a matrix. The discharge cells emit light by discharges, so that only two states, namely a "lighted state" in which they emit light at a predetermined luminance and an "unlighted state," and thus only the luminance for two gradations, can be realized. In order to address this problem, a PDP 10 provided with such discharge cells is subjected to gradation driving using the sub-field method, which is supposed to realize the display of intermediate luminances corresponding to the input video signal.

In the sub-field method, the display period of one field is divided into N sub-fields, and the number of times that the discharge cells are supposed to discharge continuously is assigned in advance to each sub-field. Within each sub-field, the individual discharge cells are caused to discharge selectively in correspondence with the input video signal, performing an addressing step in which they are set either to a lighted cell state or an unlighted cell state, and an emission sustaining step in which only for the discharge cells that are in the lighted cell state the discharge emission is repeated for the number of times that has been assigned as described above. With this driving method, intermediate luminances that correspond to the total number of discharge emissions carried out in the emission sustaining steps within one field display period can be realized.

In plasma display devices, discharges are induced during the emission sustaining step for the actual image display, but also during the addressing step, and the current flowing in the course of this discharge leads to the consumption of power. Whether a discharge occurs in the discharge cells during this addressing step depends on the input video signal. Thus, there is the problem that, depending on the input video signal that specifies the image to be displayed, the power that is consumed in the addressing step may increase.

SUMMARY OF THE INVENTION

In view of the above-described problems, it is an object of the present invention to provide a display panel driver with which the power consumption can be reduced.

In accordance with the invention claimed in claim 1, a display panel driver for driving a display panel in which capacitive light emitting cells serving as pixels are formed at intersections between a plurality of row electrodes serving as display lines and a plurality of column electrodes intersecting with the row electrodes in accordance with pixel data for the pixels based on an input video signal, includes: a pixel data pulse generation circuit which generates pixel data pulses by connecting said column electrodes and a power source line in accordance with said pixel data to apply said pixel data pulses to said column electrodes; a resonance pulse power circuit which generates a resonance pulse power source voltage to apply the resonance pulse power source voltage to the power source line, the resonance pulse power circuit changing the resonance amplitude of the resonance pulse power source voltage while keeping a maximum voltage of the resonance pulse power source voltage in accordance with a pattern of a pulse sequence of the pixel data pulses; a power prediction circuit which determines a predicted power consumption of the resonance pulse power circuit based on the pixel data for one field; and a power consumption control circuit which controls the pixel data pulse generation circuit so as to adjust the power consumption of the resonance pulse power circuit in accordance with the predicted power consumption.

In accordance with the invention claimed in claim 10, a display panel driver for driving a display panel in which capacitive light emitting cells serving as pixels are formed at intersections between a plurality of row electrodes serving as display lines and a plurality of column electrodes intersecting with the row electrodes in accordance with pixel data for the pixels based on an input video signal, includes: a pixel data pulse generation circuit which generates pixel data pulses by connecting said column electrodes and a power source line in accordance with said pixel data to apply said pixel data pulses to said column electrodes; a resonance pulse power circuit which generates a resonance pulse power source voltage to apply the resonance pulse power source voltage to the power source line, the resonance pulse power circuit changing the resonance amplitude of the resonance pulse power source voltage while keeping a maximum voltage of the resonance pulse power source voltage in accordance with a pattern of a pulse sequence of the pixel data pulses; a power prediction circuit which determines a predicted power consumption of the resonance pulse power circuit based on the pixel data for one field; and a power consumption control circuit which controls the pixel data pulse generation circuit so as to adjust the power consumption of the resonance pulse power circuit in accordance with the predicted power consumption; wherein the pixel data pulse generation circuit is divided into a plurality of IC chips respectively corresponding to column electrode groups that are made of a predetermined number of column electrodes; and wherein the IC chips are mounted on a plurality of flexible wiring boards that are respectively connected to the power source line and the column electrodes in the resonance pulse power circuit formed on the substrate of the display panel.

BRIEF DESCRIPTION OF THE DRAWINGS

FIG. 4 is a diagram showing an example of the conversion table of the second conversion circuit 34 and the driving patterns that are executed based on the pixel driving data $GD_a$ that have been converted with this conversion table, FIG. 5 is a diagram showing an example of the conversion table of the second conversion circuit 35 and the driving patterns that are executed based on the pixel driving data $GD_b$ that have been converted with this conversion table, FIG. 9 is a diagram illustrating a data bit matrix $DB_{(n,m)}$ with n rows and m columns, FIG. 13 is a diagram showing an example of the conversion table of the first conversion circuit 34 and the driving patterns that are executed based on the pixel driving data $GD_a$ that have been converted with this conversion table, when driving the PDP 10 with the selective writing addressing method, FIG. 14 is a diagram showing an example of the conversion table of the second conversion circuit 35 and the driving patterns that are executed based on the pixel driving data $GD_b$ that have been converted with this conversion table, when driving the PDP 10 with the selective writing addressing method.

DETAILED DESCRIPTION OF THE INVENTION

The following is an explanation of embodiments of the present invention, with reference to the accompanying drawings.

Figure 1:
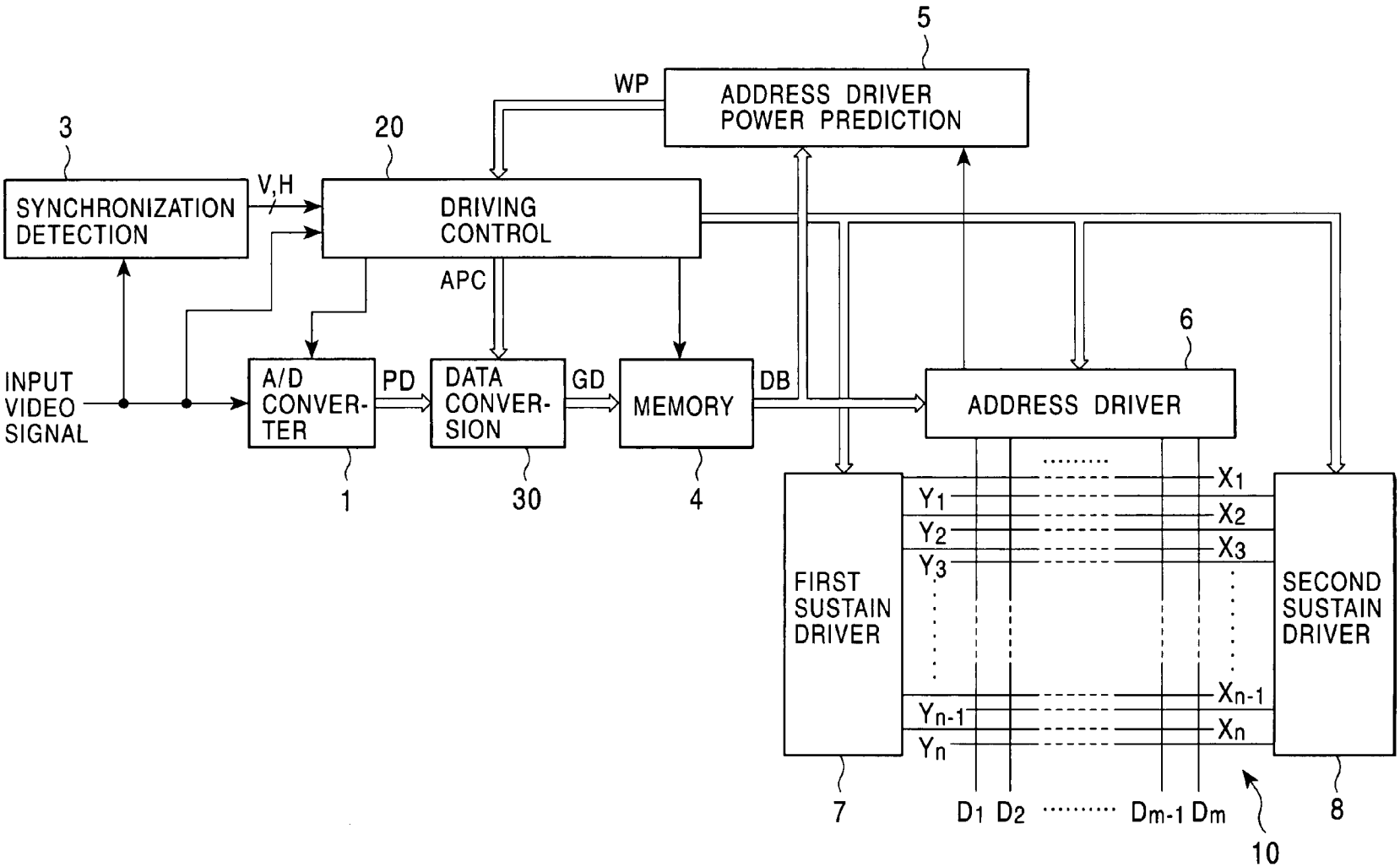
FIG. 1 is a diagram illustrating the general configuration of a plasma display device equipped with a display panel driver according to the present invention.

FIG. 1 is a diagram illustrating the general configuration of a plasma display device equipped with a display panel driver according to the present invention.

This plasma display device includes a PDP 10 serving as a plasma display panel, an A/D converter 1, a driving control circuit 20, a synchronization detection circuit 3, a memory 4, an address driver power prediction circuit 5, an address driver 6, a first sustain driver 7 and a second sustain driver 8.

The PDP 10 includes band-shaped row electrodes $X_1$ to $X_n$ and row electrodes $Y_1$ to $Y_n$ that are arranged in alternation and parallel to one another on a transparent front substrate serving as the display screen, and band-shaped column electrodes $D_1$ to $D_m$ that are arranged on the rear substrate, intersecting with the row electrodes. A heat sink is fixed to the rear substrate. The column electrodes D and the row electrodes X and Y are covered with a dielectric layer on the side of the discharge space. Discharge cells serving as pixels are formed at the intersections of the row electrodes and the column electrodes. A pair of one row electrode X and one row electrode Y serves for the display of one display line.

In response to the clock signals that are supplied from the driving control circuit 20, the A/D converter 1 samples an analog input video signal that has been input, and converts it into, for example, 8-bit pixel data PD corresponding to the pixels. The data conversion circuit 30 converts the 8-bit pixel data PD into 14-bit pixel driving data GD.

Figure 2:
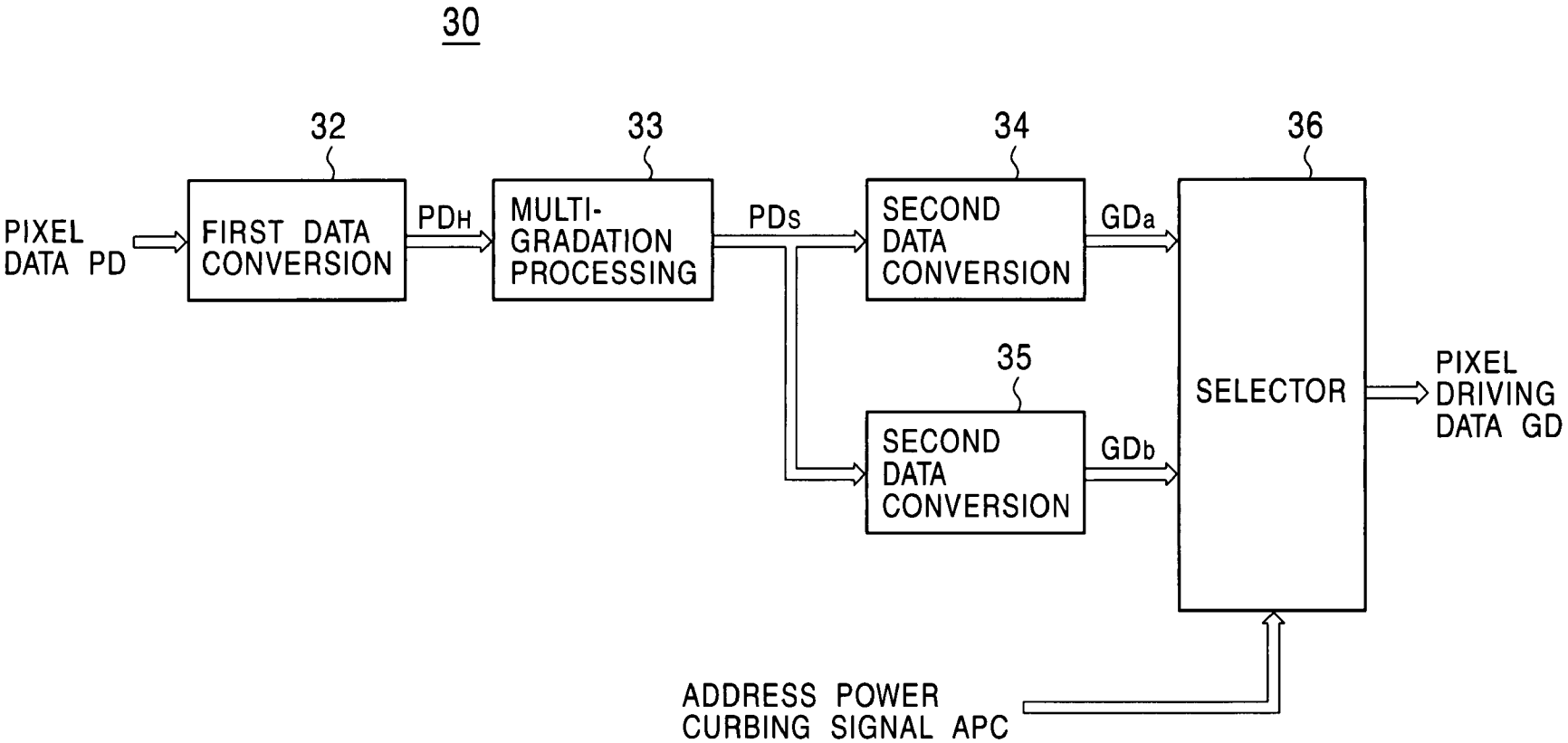
FIG. 2 is a diagram illustrating the internal configuration of the data conversion circuit 30 of the display panel device shown in FIG. 1.

FIG. 2 illustrates the internal configuration of this data conversion circuit 30.

Figure 3:
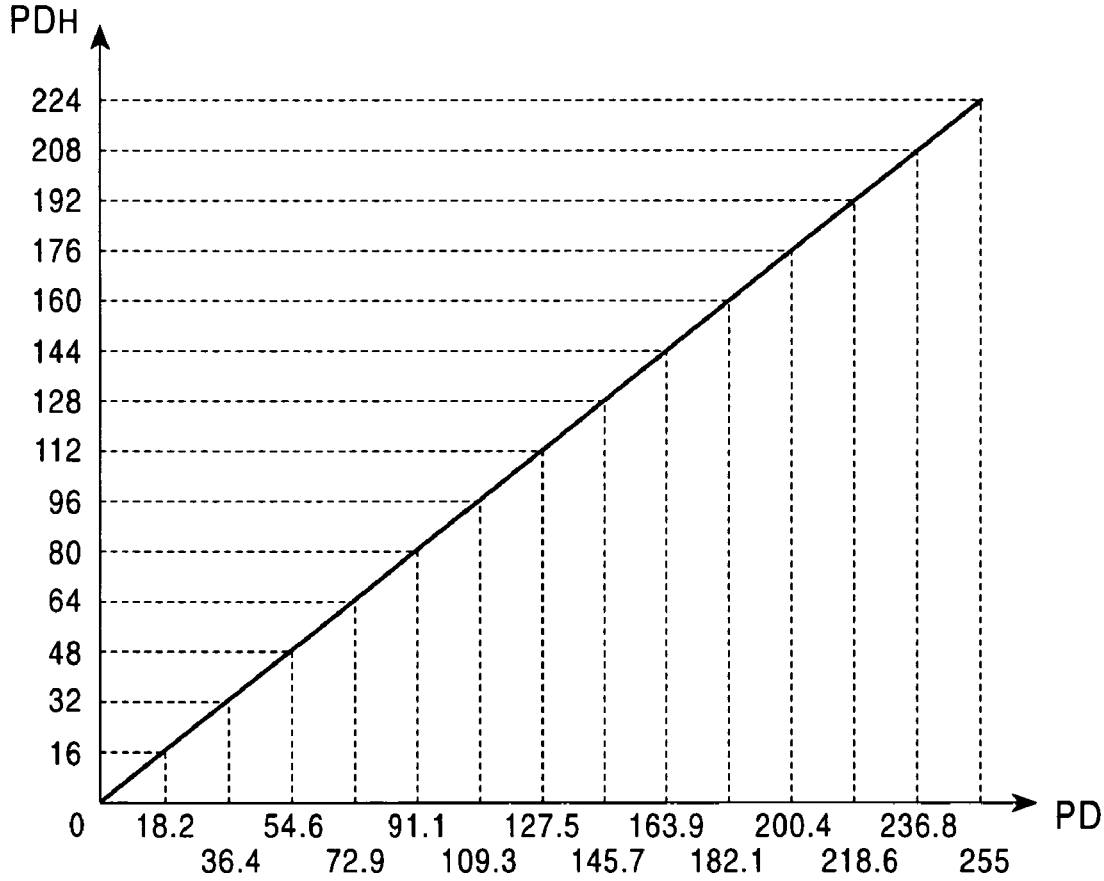
FIG. 3 is a diagram illustrating a data conversion graph in the first data conversion circuit 32 shown in FIG. 2.

In FIG. 2, a first data conversion circuit 32 converts the values of the 8-bit pixel data PD into converted pixel data $PD_H$ of 8 bits (0–224) based on the conversion graph shown in FIG. 3, obtained by converting (14×16)/255, that is, 224/255, and supplies the converted pixel data $PD_H$ to a multi-gradation processing circuit 33. The conversion graph is set in correspondence with the bit number of the pixel data PD, the compression bit number for the multi-gradation processing with the multi-gradation processing circuit 33, and the number of displayed halftones. The data conversion with the first data conversion circuit 32 prevents the saturation of luminance with the multi-gradation processing circuit (explained below) as well as flat portions in the display characteristics (that is, distortion in gradation), which may occur when the display gradation is not within the bit limit.

The multi-gradation processing circuit 33 subjects the converted pixel data $PD_H$ that have been supplied from the first data conversion circuit 32 to a multi-gradation process, such as error diffusion and dithering. Thus, the multi-gradation processing circuit 33 obtains multi-gradation pixel data $PD_S$ in which the bit number is compressed to four bits while sustaining the number of gradation halftones of luminance that are visible at substantially 256 gradations. For example, in an error diffusion process, the converted pixel data $PD_H$ are divided, taking the upper six bits as display data and the remaining lower two bits as error data. Then, the error data that have been determined from the converted pixel data $PD_H$ in accordance with the respective surrounding pixels are weighted and added, and the result is reflected in the display data. With this operation, the luminance of the lower two bits in the original pixel is artificially expressed by the surrounding pixels. As a result, it becomes possible to express a luminance gradation that is equivalent to that of eight bits of pixel data with only six bits (that is, less than eight bits) of display data. Next, the six bits of error diffusion processed pixel data that have been obtained by the error diffusion process are subjected to a dithering process. In the dithering process, a plurality of adjacent pixels are taken as one pixel unit. In the dithering process, dithered pixel data are obtained by assigning and adding dither factors made of different factors to the error diffusion processed pixel data corresponding to the pixels in this one pixel unit. With the addition of dither factors, it becomes possible to achieve a luminance equivalent to eight bits with only the four upper bits of the dithered pixel data, when looked at in one pixel unit. The multi-gradation processing circuit 33 extracts the upper four bits from the dithered pixel data, and taking the result as the multi-gradation pixel data $PD_S$, sends them to the second data conversion circuits 34 and 35.

The second data conversion circuit 34 converts the 4-bit multi-gradation pixel data $PD_S$ into 14-bit pixel driving data $GD_a$ in accordance with the conversion table shown in FIG. 4, and supplies these pixel driving data $GD_a$ to a selector 36. The second data conversion circuit 35 converts the 4-bit multi-gradation pixel data $PD_S$ into 14-bit pixel driving data $GD_b$ in accordance with the conversion table shown in FIG. 5, and supplies these pixel driving data $GD_b$ to the selector 36.

If an address power curbing signal APC with the logic level "0" is supplied from the driving control circuit 20, then the selector 36 selects the pixel driving data $GD_a$ from $GD_a$ and $GD_b$, and supplies them as the pixel driving data GD to the memory 4. Conversely, if an address power curbing signal APC with the logic level "1" is supplied from the driving control circuit 20, then the selector 36 selects the pixel driving data $GD_b$, and supplies them as the pixel driving data GD to the memory 4.

The memory 4 sequentially reads in the 14-bit pixel driving data GD in accordance with a read signal supplied from the driving control circuit 20. Then, when the reading of the pixel driving data $GD_{1,1}$ to $GD_{n,m}$ for one screen (n rows, m columns) is completed, the memory 4 reads out the written data, in accordance with a read signal supplied from the driving control circuit 20, in the following manner: The memory 4 reads out the pixel driving data $GD_{1,1}$ to $GD_{n,m}$ one display line at a time for each bit digit (first to fourteenth bit), and supplies them as pixel driving data bits DB1 to DB(m) to the address driver 6. In other words, at the later-explained sub-field SF1, the memory 4 reads out only the first bit of the pixel driving data $GD_{1,1}$ to $GD_{n,m}$ for one display line at a time, and supplies it as the pixel driving data bits DB1 to DB(m) to the address driver 6. In the sub-field SF2, the memory 4 reads out only the second bit of the pixel driving data $GD_{1,1}$ to $GD_{n,m}$ for one display line at a time, and supplies it as the pixel driving data bits DB1 to DB(m) to the address driver 6. In the sub-field SF3, the memory 4 reads out only the third bit of the pixel driving data $GD_{1,1}$ to $GD_{n,m}$ for one display line at a time, and supplies it as the pixel driving data bits DB1 to DB(m) to the address driver 6. In the sub-field SF4 and all following sub-fields, the memory 4 similarly reads out only the bit corresponding to the respective sub-field of the pixel driving data $GD_{1,1}$ to $GD_{n,m}$ for one display line at a time, and supplies it as the pixel driving data bits DB1 to DB(m) to the address driver 6.

The address driver 6 generates m pixel data pulses for one display line, in correspondence with the pixel driving data bits DB1 to DB(m) that have been supplied from the memory 4, and applies them respectively to the column electrodes $D_1$ to $D_m$.

Figure 6:
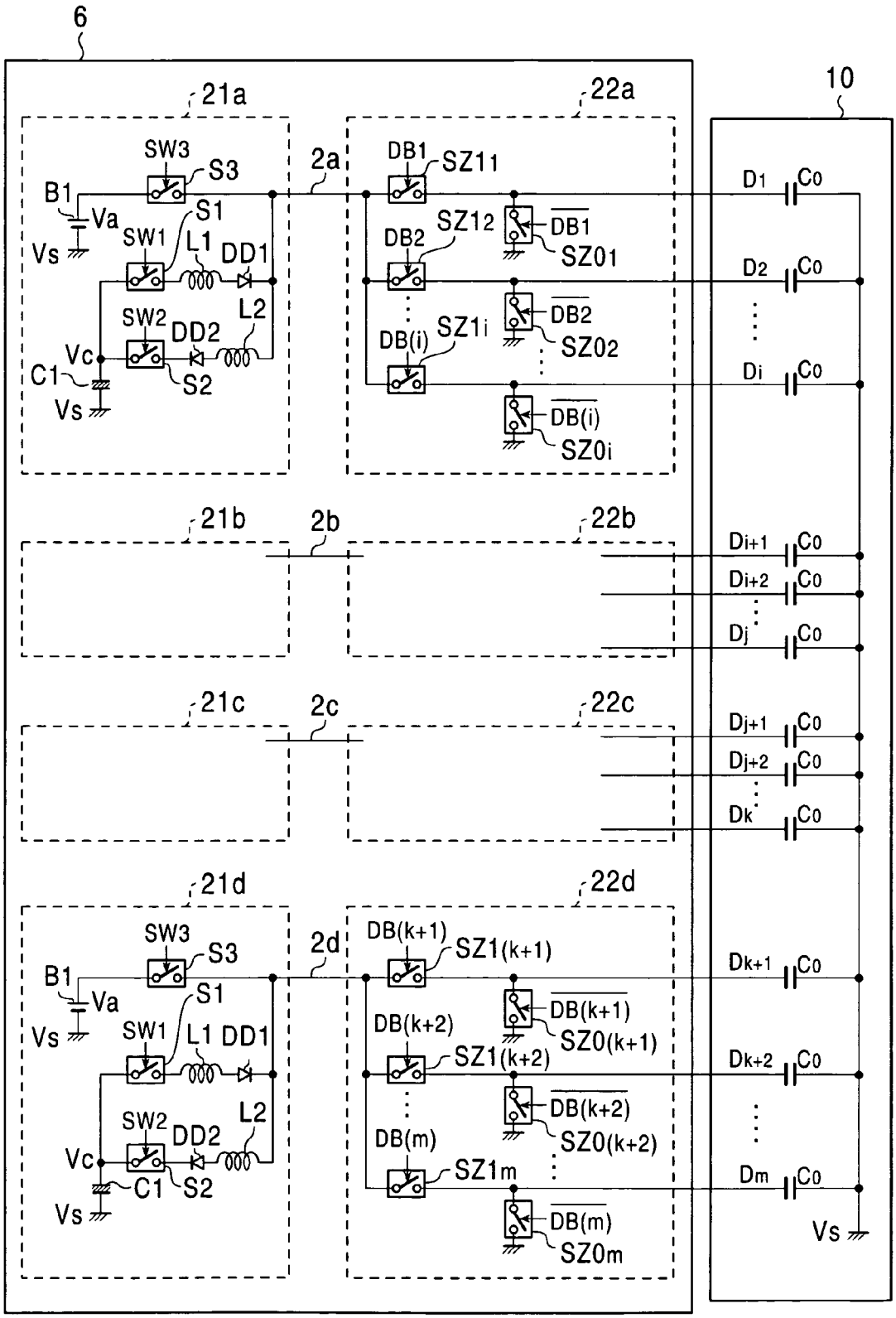
FIG. 6 is a diagram illustrating the internal configuration of the address driver 6 shown in FIG. 1, FIGS. 7A to 7D are diagrams illustrating the internal operation of the address driver 6.

FIG. 6 is a diagram illustrating the internal configuration of the address driver 6.

As shown in FIG. 6, the address driver 6 includes resonance pulse power circuits 21*a* to 21*d* and pixel data pulse generation circuits 22*a* to 22*d*.

The various resonance pulse power circuits 21*a* to 21*d* are made of a DC power source B1, a capacitor C1, switching elements S1 to S3, coils L1 and L2, and diodes DD1 and DD2. The capacitor C1 is grounded by connecting one end of it to a PDP ground potential Vs serving as the ground potential of the PDP 10. The switching element S1 is in the OFF state while it is supplied by the driving control circuit 20 with a switching signal SW1 of the logic level "0" On the other hand, if the logic level of the switching signal SW1 is "1" then the switching element assumes the ON state, and the voltage generated at the other end of the capacitor C1 is applied via the coil L1 and the diode DD1 to the power source line 2. The switching element S2 is in the OFF state while it is supplied by the driving control circuit 20 with a switching signal SW2 of the logic level "0" On the other hand, if the logic level of the switching signal SW2 is "1" then the switching element S2 assumes the ON state, and the voltage on the power source line 2 is applied via the coil L2 and the diode DD2 to the other end of the capacitor C1. In this situation, the capacitor C1 is charged by the voltage on the power source line 2. The switching element S3 is in the OFF state while it is supplied by the driving control circuit 20 with a switching signal SW3 of the logic level "0" On the other hand, if the logic level of the switching signal SW3 is "1" then the switching element S3 assumes the ON state, and the DC power source voltage Va generated by the DC power source B1 is applied to the power source line 2.

In response to switching signals SW1 to SW3 that are supplied from the driving control circuit 20 in the sequence indicated by the driving steps G1 to G3 shown in FIG. 7D in order to drive the switching elements S1 to S3, the resonance pulse power circuits 21*a* to 21*d* generate a resonance pulse power source voltage having a predetermined amplitude, which is applied to the power source lines 2*a* to 2*d*.

First, in the driving step G1 in FIG. 7D, only the switching element S1 of the switching elements S1 to S3 is in the ON state, and the charge accumulated in the capacitor C1 is discharged. In this situation, when the switching elements SZ1 (explained later) of the pixel data pulse generation circuit 22 are in the ON state, then the discharge current from this discharge flows over the current discharge path constituted by the switching element S1, the coil L1 and the diode DD1, and then the power source line 2 and the switching element SZ1 to the column electrode D of the PDP 10, as shown in FIG. 6. Due to this discharge current, the load capacitance $C_0$ of the column electrode D is charged, and charge is accumulated in this load capacitance $C_0$. Then, due to resonance between the coil L1 and the load capacitance $C_0$, the voltage on the power source line 2 gradually increases, and reaches the voltage Va, which is twice the voltage of the voltage Vc at the one end of the capacitor C1. In this situation, the smoothly rising voltage portion on the power source line 2 becomes the front edge portion of the resonance pulse power source voltage.

Next, in the driving step G2, only the switching element S3 of the switching elements S1 to S3 assumes the ON state, and the DC voltage Va from the DC power source B1 is applied via the switching element S3 to the power source line 2. In this situation, when the switching elements SZ1 (explained later) of the pixel data pulse generation circuit 22 ate in the ON state, then a current due the DC voltage Va flows via the switching element SZ1 to the column electrode D of the PDP 10, and the load capacitance CO of the column electrode D is charged. Due to this charging, charge is accumulated in the load capacitance $C_0$.

Then, in the driving step G3, only the switching element S2 of the switching elements S1 to S3 assumes the ON state, and the load capacitance $C_0$ of the column electrode D starts to discharge. Due to this discharge, current flows to the capacitor C1 via the column electrode D, the switching elements SZ1, the power source line 2 and the current discharge path constituted by the coil L2, the diode DD2 and the switching element S2. That is to say, the charge that has accumulated in the load capacitance $C_0$ of the PDP 10 is collected in the capacitor C1 of the resonance pulse power circuit 21. At this time, the voltage on the power source line 2 gradually decreases in accordance with the time constant depending on the coil L2 and the load capacitance $C_0$. Also the smoothly decreasing voltage portion on the power source line 2 becomes the rear edge portion of the resonance pulse power source voltage.

Each of the resonance pulse power circuits 21*a* to 21*d* supplies a resonance pulse power source voltage generated by executing the driving sequence explained above (G1 to G3) to a corresponding pixel data pulse generation circuit 22*a* to 22*d* via the power source lines 2*a* to 2*d*.

The pixel data pulse generation circuit 22*a* is made of switching elements $SZ0_1$ to $SZ0_1$ and switching elements $SZ1_1$ to $SZ1_i$ that are independently turned on and off in response to the pixel driving data bits DB1 to DB(i) supplied from the memory 4. When the logic level of the pixel driving data bits DB1 to DB(i) respectively supplied to the switching elements $SZ1_1$ to $SZ1_i$ is "1" the switching elements $SZ1_1$ to $SZ1_i$ are turned on, and the resonance pulse power source voltage supplied from the resonance pulse power circuit 21*a* via the power source line 2*a* is applied to the column electrodes D1 to D1 of the PDP 10. When the logic level of the pixel driving data bits DB1 to DB(i) respectively supplied to the switching elements $SZ0_1$ to $SZ0_i$ is "0" the switching elements $SZ0_1$ to $SZ0_i$ are turned on, and the voltage of the column electrodes $D_1$ to $D_i$ is forced to the PDP ground potential Vs. As a result of this operation, only in the case that the logic level of the pixel driving data bits DB1 to DB(i) is "1" the pixel data pulse generation circuit 22*a* generates a high-voltage pixel data pulse and applies it to the column electrodes $D_1$ to $D_i$. It should be noted that when the logic level of the pixel driving data bits DB1 to DB(i) is "0" the pixel data pulse generation circuit 22*a* applies a low voltage (0 Volt) to the respective column electrodes $D_1$ to $D_i$.

The pixel data pulse generation circuit 22*b* is made of switching elements $SZ0_{(i+1)}$ to $SZ0_j$ and switching elements $SZ1_{(i+1)}$ to $SZ1_j$ that are independently turned on and off in response to the pixel driving data bits DB(i+1) to DB(j) supplied from the memory 4. When the logic level of the pixel driving data bits DB(i+1) to DB(j) respectively supplied to the switching elements $SZ1_{(i+1)}$ to $SZ1_j$ is "1" the switching elements $SZ1_{(i+1)}$ to $SZ1_j$ are turned on, and the resonance pulse power source voltage supplied from the resonance pulse power circuit 21*b* via the power source line 2*b* is applied to the column electrodes $D_{(i+1)}$ to $D_j$ of the PDP 10. When the logic level of the pixel driving data bits DB(i+1) to DB(j) respectively supplied to the switching elements $SZ0_{(i+1)}$ to $SZ0_j$ is "0" the switching elements $SZ0_{(i+1)}$ to $SZ0_j$ are turned on, and the voltage of the column electrodes $D_{(i+1)}$ to $D_j$ is forced to the PDP ground potential Vs. As a result of this operation, only in the case that the logic level of the pixel driving data bits DB(i+1) to DB(j) is "1" the pixel data pulse generation circuit 22*b* generates a high-voltage pixel data pulse and applies it to the column electrodes $D_{(i+1)}$ to $D_j$. It should be noted that when the logic level of the pixel driving data bits DB(i+1) to DB(j) is "0" the pixel data pulse generation circuit 22*b* applies a low voltage (0 Volt) to the respective column electrodes $De_{(i+1)}$ to $D_j$.

The pixel data pulse generation circuit 22*c* is made of switching elements $SZ0_{(j+1)}$ to $SZ0_k$ and switching elements $SZ1_{(j+1)}$ to $SZ1_k$ that are independently turned on and off in response to the pixel driving data bits DB(j+1) to DB(k) supplied from the memory 4. When the logic level of the pixel driving data bits DB(j+1) to DB(k) respectively supplied to the switching elements $SZ1_{(j+1)}$ to $SZ1_k$ is "1" the switching elements $SZ1_{(j+1)}$ to $SZ1_k$ are turned on, and the resonance pulse power source voltage supplied from the resonance pulse power circuit 21*c* via the power source line 2*c* is applied to the column electrodes $D_{(j+1)}$ to $D_k$ of the PDP 10. When the logic level of the pixel driving data bits DB(j+1) to DB(k) respectively supplied to the switching elements $SZ0_{(j+1)}$ to $SZ0_k$ is "0" the switching elements $SZ0_{(j+1)}$ to $SZ0_k$ are turned on, and the voltage of the column electrodes $D_{(j+1)}$ to $D_k$ is forced to the PDP ground potential Vs. As a result of this operation, only in the case that the logic level of the pixel driving data bits DB(j+1) to DB(k) is "1" the pixel data pulse generation circuit 22*c* generates a high-voltage pixel data pulse and applies it to the column electrodes $D_{(j+1)}$ to $D_k$. It should be noted that when the logic level of the pixel driving data bits DB(j+1) to DB(k) is "0" the pixel data pulse generation circuit 22*c* applies a low voltage (0 Volt) to the respective column electrodes $D_{(j+1)}$ to $D_k$.

The pixel data pulse generation circuit 22*d* is made of switching elements $SZ0_{(k+1)}$ to $SZ0_m$ and switching elements $SZ1_{(k+1)}$ to $SZ1_m$ that are independently turned on and off in response to the pixel driving data bits DB(k+1) to DB(m) supplied from the memory 4. When the logic level of the pixel driving data bits DB(k+1) to DB(m) respectively supplied to the switching elements $SZ1_{(k+1)}$ to $SZ1_m$ is "1" the switching elements $SZ1_{(k+1)}$ to $SZ1_m$ are turned on, and the resonance pulse power source voltage supplied from the resonance pulse power circuit 21*d* via the power source line 2*d* is applied to the column electrodes $D_{(k+1)}$ to $D_m$ of the PDP 10. When the logic level of the pixel driving data bits DB(k+1) to DB(m) respectively supplied to the switching elements $SZ0_{(k+1)}$ to $SZ0_m$ is "0" the switching elements $SZ0_{(k+1)}$ to $SZ0_m$ are turned on, and the voltage of the column electrodes $D_{(k+1)}$ to $D_m$ is forced to the PDP ground potential Vs. As a result of this operation, only in the case that the logic level of the pixel driving data bits DB(k+1) to DB(m) is "1" the pixel data pulse generation circuit 22*d* generates a high-voltage pixel data pulse and applies it to the column electrodes $D_{(k+1)}$ to $D_m$. It should be noted that when the logic level of the pixel driving data bits DB(k+1) to DB(m) is "0" the pixel data pulse generation circuit 22*d* applies a low voltage (0 Volt) to the respective column electrodes $D_{(k+1)}$ to $D_m$.

Figure 8:
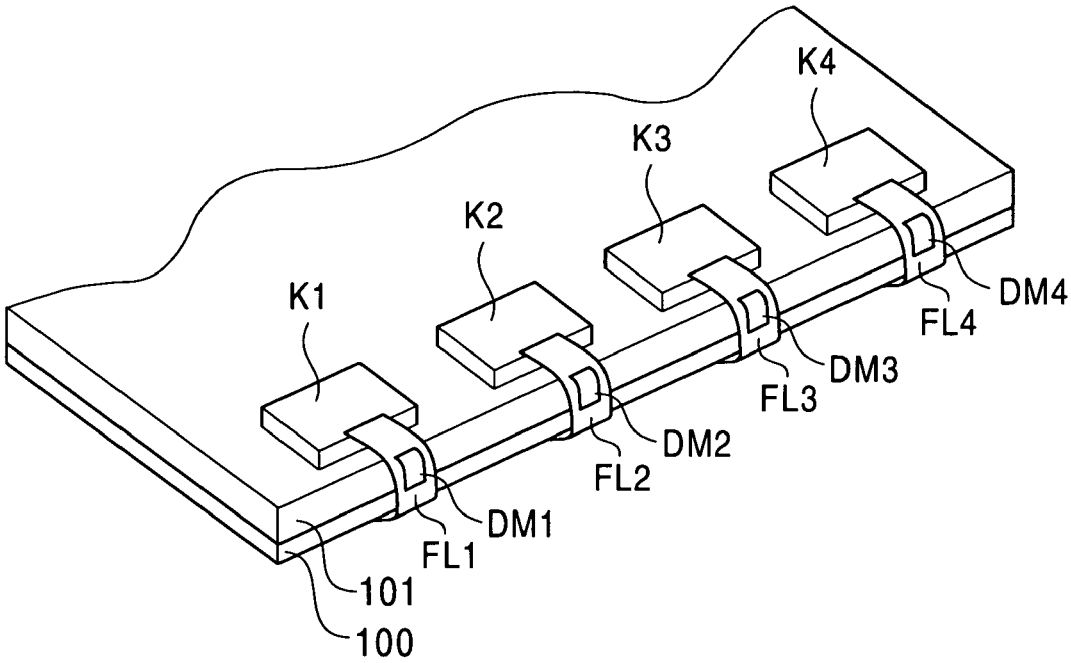
FIG. 8 is a diagram illustrating an embodiment of the address driver 6.

The resonance pulse power circuits 21*a* to 21*d* and the pixel data pulse generation circuits 22*a* to 22*d* are installed in the PDP 10 in the form shown in FIG. 8.

The circuit board K1 on which the resonance pulse power circuits 21*a* is constructed, the circuit board K2 on which the resonance pulse power circuits 21*b* is constructed, the circuit board K3 on which the resonance pulse power circuits 21*c* is constructed, and the circuit board K4 on which the resonance pulse power circuits 21*d* is constructed are all fastened to one side of a heat sink 101. The rear substrates 100 on which the column electrodes $D_1$ to $D_m$ are arranged are fastened to the other side of the heat sink 101. The circuit board K1 and the rear substrate 100 are connected to a flexible cable FL1. On this flexible cable FL1, a driver module DM1 is provided, on which the pixel data pulse generation circuit 22*a* is integrated into an IC chip. A power source line corresponding to the power source line 2*a* in FIG. 6 as well as i transmission lines for transmitting the pixel data pulses generated by the pixel data pulse generation circuit 22*a* to the column electrodes $D_1$ to $D_i$ are provided inside the flexible cable FL1. Furthermore, the circuit board K2 and the rear substrate 100 are connected to a flexible cable FL2. On this flexible cable FL2, a driver module DM2 is provided, on which the pixel data pulse generation circuit 22*b* is integrated into an IC chip. A power source line corresponding to the power source line 2*b* in FIG. 6 as well as j-i transmission lines for transmitting the pixel data pulses generated by the pixel data pulse generation circuit 22*b* to the column electrodes $D_{(i+1)}$ to $D_j$ are provided inside the flexible cable FL2. Furthermore, the circuit board K3 and the rear substrate 100 are connected to a flexible cable FL3. On this flexible cable FL3, a driver module DM3 is provided, on which the pixel data pulse generation circuit 22*c* is integrated into an IC chip. A power source line corresponding to the power source line 2*c* in FIG. 6 as well as k-j transmission lines for transmitting the pixel data pulses generated by the pixel data pulse generation circuit 22*c* to the column electrodes $D_{(j+1)}$ to $D_k$ are provided inside the flexible cable FL3. Furthermore, the circuit board K4 and the rear substrate 100 are connected to a flexible cable FL4. On this flexible cable FL4, a driver module DM4 is provided, on which the pixel data pulse generation circuit 22*d* is integrated into an IC chip. A power source line corresponding to the power source line 2*d* in FIG. 6 as well as m-k transmission lines for transmitting the pixel data pulses generated by the pixel data pulse generation circuit 22*d* to the column electrodes $D_{(k+1)}$ to $D_m$ are provided inside the flexible cable FL4.

Based on the pixel driving data bits DB, an address driver power prediction circuit 5 measures a predicted power consumption that is likely to be consumed by the pixel data pulse generation circuits 22*a* to 22*d* of the address driver 6, and supplies a predicted address power value WP representing this predicted power consumption to the driving control circuit 20.

For example, the address driver power prediction circuit 5 first places the pixel driving data bits $DB_{1,1}$ to $DB_{n,m}$ for one screen (that is, n rows and m columns) in a data bit matrix $DB_{(n,m)}$ with n rows and m columns, as shown in FIG. 9. Then, the address driver power prediction circuit 5 determines for each row in the data bit matrix $DB_{(n,m)}$, in the manner described below, the total number of data bits DB whose logic level is "1" obtaining a pulse sum $P_N$:

$$P_N = \sum_{M=1}^{m} DB_{(N,M)} \quad (N: 1 \text{ to } n)$$

Moreover, the address driver power prediction circuit 5 determines for each row in the data bit matrix $DB_{(n,m)}$, in the manner described below, the total number of instances in which two data bits DB that are adjacent in horizontal direction have different logic levels, obtaining a horizontal change sum $Q_N$:

$$Q_N = \sum_{M=1}^{m} |DB_{(N,M)} - DB_{(N,M+1)}| \quad (N: 1 \text{ to } n)$$

Moreover, the address driver power prediction circuit 5 determines for each row in the data bit matrix $DB_{(n,m)}$, in the manner described below, the total number of instances in which two data bits DB that are adjacent in vertical direction have different logic levels, obtaining a vertical change sum $R_N$:

$$R_N = \sum_{M=1}^{m} |DB_{(N,M)} - DB_{(N+1,M)}| \quad (N: 1 \text{ to } n)$$

Moreover, the address driver power prediction circuit 5 determines for each row in the data bit matrix $DB_{(n,m)}$, in the manner described below, the total number of instances in which the logic levels of the data bits DB in both the vertical direction and the horizontal direction are different, obtaining a vertical-lateral change sum $S_N$:

$$S_N = \sum_{M=1}^{m} ||DB_{(N,M)} - DB_{(N+1,M)}| - |DB_{(N,M+1)} - DB_{(N+1,M+1)}||$$

(N: 1 to n)

Next, with the following calculation using the pulse sum $P_N$, the horizontal change sum $Q_N$, the vertical change sum $R_N$ and the vertical-horizontal change sum $S_N$, the address driver power prediction circuit 5 determines a DC driving power parameter $A_N$ and a resonance driving power parameter $B_N$:

$$A_N = (C_{AS} \cdot R_N + C_{AA} \cdot S_N)/2$$
$$B_N = C_K + [C_{AS}(P_N + P_{N+1}) + C_{AA}(Q_N + Q_{N+1})]/2$$

N: 1 to n;

$C_{AS}$: capacitance between column electrodes and row electrodes;

$C_{AA}$: capacitance between column electrodes $C_K$: capacitance between GND and power source of the address driver 6

It should be noted that the resonance driving power source parameter $B_N$ represents the power that is consumed in the pixel data pulse generation circuit 22 when the resonance pulse power source voltage is applied to the power source line 2 in the address driver 6 as shown in FIG. 6. On the other hand, the DC driving power parameter $A_N$ expresses the power that is consumed in the pixel data pulse generation circuit 22 when the resonance pulse power source voltage is turned into a DC voltage.

The address driver power prediction circuit 5 determines the predicted address power value WP for one field (SF1 to SF14) by the following calculation, which is based on the root mean square of the DC driving power parameter $A_N$ and the resonance driving power parameter $B_N$:

$$WP = B \cdot V^2 \cdot (F/10^{14}) \times \sum_{SF=1}^{14} \sqrt{\left\{\sum_{N=1}^{n} A_N \times \sum_{N=1}^{n} B_N\right\}}$$

B: resonance coefficient

V: voltage of pixel data pulse DP

F: field frequency

SF: sub-field

If the predicted power consumption of the address driver 6 indicated by the predicted address power value WP is lower than a predetermined power, then the driving control circuit 20 supplies an address power curbing signal APC with the logic level "0" and if it is larger than that predetermined then the driving control circuit 20 supplies an address power curbing signal APC with the logic level "1" to the selector 36 of the data conversion circuit 30.

Figure 10:
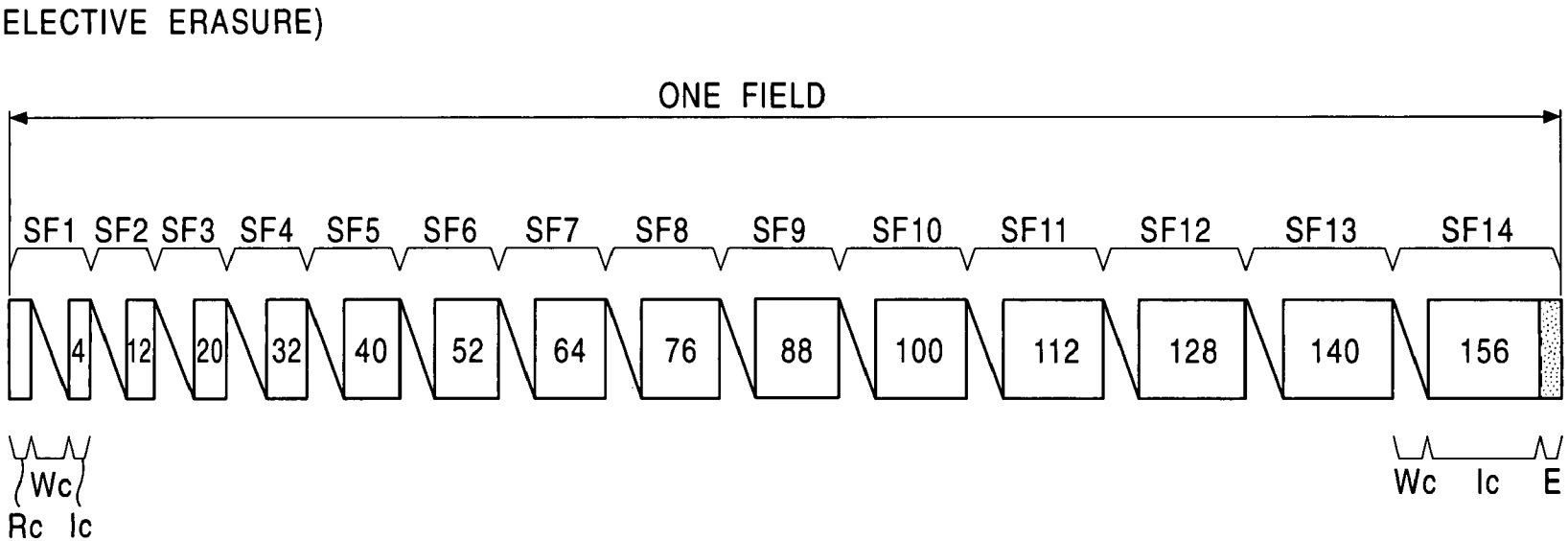
FIG. 10 is a diagram illustrating an example of the format of the light-emission driving that is used when driving the PDP 10 with the selective erasing addressing method.

Furthermore, the driving control circuit 20 supplies various timing signals that are supposed to control the driving of the PDP 10 in accordance with the emission driving format shown in FIG. 10 to the address driver 6, the first sustain driver 7 and the second sustain driver 8.

With the emission driving format shown in FIG. 10, the PDP 10 is driven by dividing the display period of one field into fourteen sub-fields SF1 to SF14. For this, an addressing step Wc and an emission sustain step Ic are performed in each sub-field, a universal reset step Rc is executed only for the first sub-field SF1, and a erasing step E is executed only for the last sub-field SF14.

Figure 11:
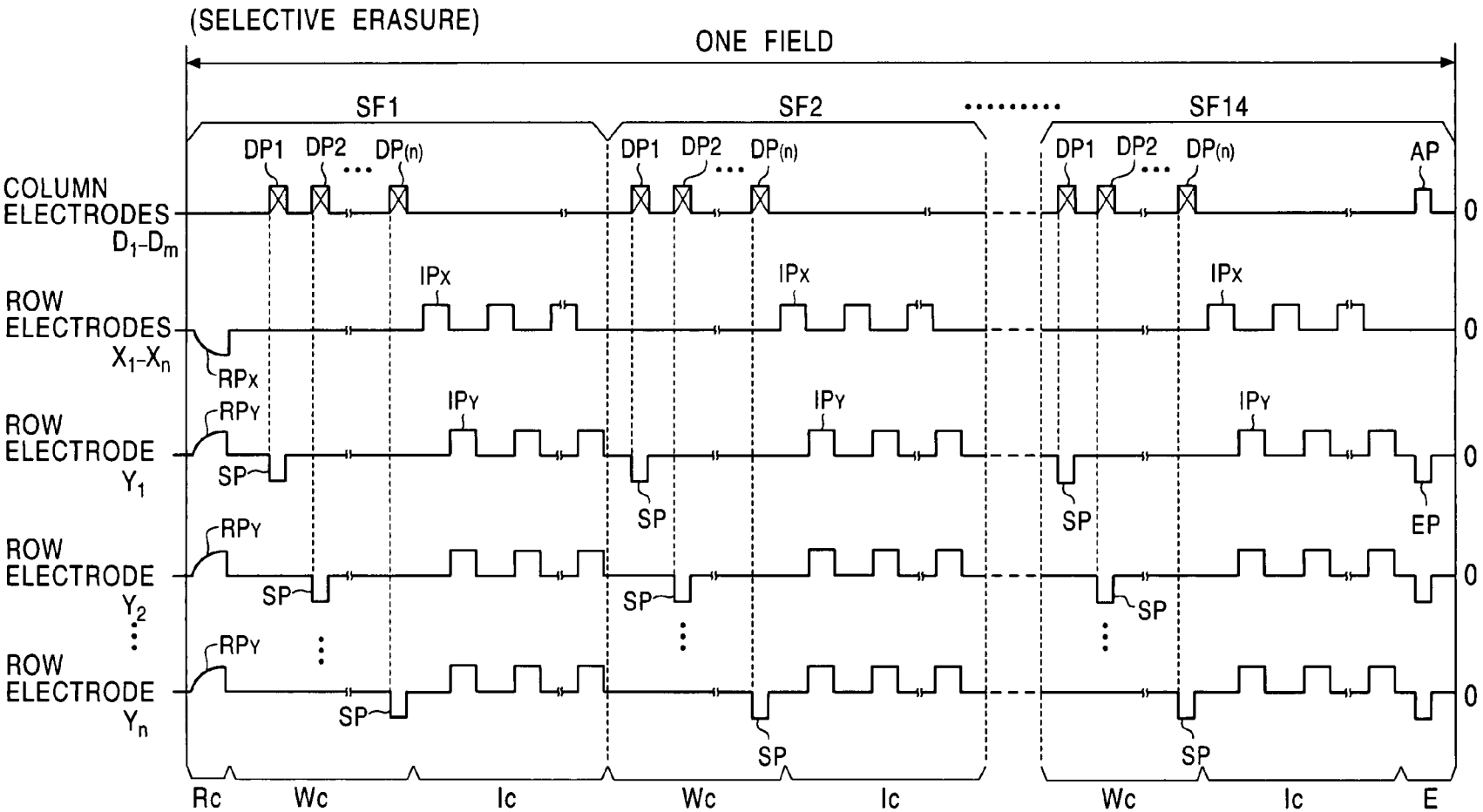
FIG. 11 is a diagram illustrating the timing at which the various driving pulses are applied to the PDP 10 in accordance with the light-emission driving that is shown in FIG. 10.

FIG. 11 is a diagram illustrating the various driving pulses that are applied to the PDP 10 by the address driver 6, the first sustain driver 7 and the second sustain driver 8 during the universal reset step Rc, the addressing step Wc, the emission sustain step Ic and the erasing step E, as well as their application timing.

First, at the universal reset step Rc, which is executed only for the sub-field SF1, the first sustain driver 7 and the second sustain driver 8 universally apply reset pulses $RP_X$ and $RP_Y$ having the waveform shown in FIG. 11 to the row electrodes $X_1$ to $X_n$ and $Y_1$ to $Y_n$ of the PDP 10. As a result of the universal application of these reset pulses $RP_X$ and $RP_Y$, all discharge cells in the PDP 10 are reset and discharged. Then, immediately after this reset discharge, a predetermined wall charge is formed uniformly in the discharge cells, and all discharge cells are initialized to the lighted cell state.

Next, in the addressing step Wc in the sub-fields, the address driver 6 generates the pixel data pulses DP for one display line in correspondence with the pixel driving data bits DB1 to DB(m) supplied from the memory 4, and applies them to the column electrodes $D_1$ to $D_m$. For example, in the addressing step Wc of the sub-field SF1, only the first bits of the pixel driving data $GD_{1,1}$ to $GD_{n,m}$ are supplied, display line by display line, as the pixel driving data bits DB1 to DB(m). Thus, the address driver 6 converts the pixel driving data bits DB that are made up of the first bits of the pixel driving data $GD_{1,1}$ to $GD_{n,m}$, one display line at a time, into pixel data pulses DP having a voltage that corresponds to the logic level of those data bits, and applies them to the column electrodes $D_1$ to $D_m$. That is to say, in the addressing step Wc of the sub-field SF1, the address driver 6 generates pixel data pulse groups DP1, DP2, DP3, . . . , DP(n) corresponding to the first display line to the n-th display line, based on the first bits of the pixel driving data $GD_{1,1}$ to $GD_{n,m}$. Then, the pixel data pulse groups DP1 to DP(n) are successively applied to the column electrodes $D_1$ to $D_m$, as shown in FIG. 11. Furthermore, in the addressing step Wc of the sub-field SF2, the address driver 6 generates pixel data pulse groups DP1, DP2, DP3, . . . , DP(n) corresponding to the first display line to the n-th display line, based on the second bits of the pixel driving data $GD_{1,1}$ to $GD_{n,m}$. Then, the pixel data pulse groups DP1 to DP(n) are successively supplied to the column electrodes $D_1$ to $D_m$, as shown in FIG. 11.

Moreover, in each of the addressing steps Wc, the second sustain driver 8 generates scan pulses SP as shown in FIG. 11 at the same timing as the application timing of the pixel data pulse groups DP1 to DP(n) explained above, and these scan pulses are successively applied to the row electrodes $Y_1$ to $Y_n$. In this situation, a discharge (selective erasing discharge) occurs selectively at the intersection of the row electrode to which the scan pulse is applied and the column electrode to which the high-voltage pixel data pulse is applied, and the wall charge that has remained in the discharge cell is eliminated. Here, the discharge cells in which this selective erasing discharge is induced and the wall charge is lost are set to an unlighted cell state. On the other hand, in the discharge cells in which this selective erasing discharge is not induced, the wall charge generated in the universal reset step Rc remains, and those discharge cells are set to the lighted cell state.

That is to say, by executing the addressing step Wc, the discharge cells are set either to the lighted cell state in which they can perform a discharge (sustained discharge) in the following emission sustain step Ic or to an unlighted cell state in which they are not discharged in the emission sustain step Ic.

Next, in the emission sustain step Ic, which is executed in each sub-field, the first sustain driver 7 and the second sustain driver 8 repeatedly apply the sustain pulses $IP_X$ and $IP_Y$ in alternation to the row electrodes $X_1$ to $X_n$ and $Y_1$ to $Y_n$, as shown in FIG. 11. It should be noted that the number of sustain pulses IP that are applied in this emission sustain step Ic differs for each sub-field, as shown in FIG. 10.

That is to say, if the number of sustain pulses that are applied in the emission sustain step IC of the sub-field SF1 is taken as "4" then:

SF1: 4
SF2: 12
SF3: 20
SF4: 32
SF5: 40
SF6: 52
SF7: 64
SF8: 76
SF9: 88
SF10: 100
SF11: 112
SF12: 128
SF13: 140
SF14: 156

The discharge of only the discharge cells in which the wall charge remains unchanged, that is, only the discharge cells that have been set to the lighted cell state in the addressing step Wc is sustained every time the sustain pulses $IP_X$ and $IP_Y$ are applied, and the emission state brought about by this sustained discharge is sustained for the number of discharges that is assigned to each sub-field. Whether the discharge cells are set to the lighted cell state in the addressing step Wc is decided by the pixel driving data GD, which are generated based on the input video signal. As the patterns that can be taken up as the 14-bit pixel driving data GD, there are the fifteen patterns shown in FIG. 4 and FIG. 5.

Apart from the pixel driving data for the multi-gradation pixel data $PD_S$ "0000," which represents the lowest luminance, the first bits of the pixel driving data GD shown in FIG. 4 and FIG. 5 have the logic level "0" From the second bit onward, there is a number of consecutive logic level "0" that corresponds to the level of luminance that is to be expressed. Furthermore, apart from the pixel driving data for the multi-gradation pixel data $PD_S$ "1110," which represents the highest luminance, only the bit following the series of logic level "0" of the pixel driving data GD shown in FIG. 5 is a logic level "1" and all bits after that are again a series of logic level "0" In the pixel driving data GD shown in FIG. 4 on the other hand, all bits following the series of logic level "0" are logic level "1"

When driving with the pixel driving data GD shown in FIG. 4 and FIG. 5, a selective erasing discharge is induced only at the addressing step Wc of the sub-fields marked by black circles in FIG. 4 and FIG. 5. That is to say, the wall charges formed in all discharge cells in the universal reset step Rc remain until the selective erasing discharge is induced, and sustain discharges are induced consecutively in the emission sustain step Ic of all sub-fields in which they are still present. Then, when the selective erasing discharge is induced in the sub-fields marked by black circles in FIG. 4 and FIG. 5, the wall charge remaining in the discharge cells is extinguished, and those discharge cells transition to the unlighted cell state, which is sustained to the last sub-field SF14. Thus, within one field period, the discharge cells are kept in the lighted cell state up to the addressing step Wc in which the first selective erasing discharge is induced (indicated by the black circles), and light is emitted consecutively in the emission sustain step Ic of the sub-fields during that time (indicated by the white circles).

Consequently, intermediate luminance display with the fifteen gradations can be attained, such that the visual emission luminance ratios according to the pixel driving data GD for the fifteen patterns shown in FIG. 4 and FIG. 5 become

{0, 4, 16, 36, 68, 108, 160, 224, 300, 388, 488, 600, 728, 868, 1024}.

Here, when driving using the pixel driving data $GD_b$ shown in FIG. 5, the number of selective erasing discharges induced within one field period is maximally one. The wall charge can be formed only in the universal reset step Rc of the sub-field SF1 in each field period, so that the discharge cells can be held at the unlighted cell state once the selective erasing discharge has been induced. Now, if the selective erasing discharge is induced not properly, then some of the wall charge remains in the discharge cell, so that an incorrect sustain discharge may be induced in the following emission sustain steps Ic. In order to address this problem, by driving using the pixel driving data $Gd_a$ shown in FIG. 4, in each addressing step Wc of the sub-fields following the consecutive emission indicated by the white circles in FIG. 4, a selective erasing discharge is induced consecutively as indicated by the black circles. With this driving method, even if the first selective erasing discharge is an incomplete discharge and not all of the wall charge in the discharge cell can be extinguished, the wall discharge can be extinguished by the second and further selective erasing discharges, so that a deterioration of the display due to incomplete discharge can be prevented.

Furthermore, the driving control circuit 20 selects one of the driving methods shown in FIG. 4 and FIG. 5 in accordance with the predicted address power value WP representing the predicted power consumption of the address driver 6 predicted by the address driver power prediction circuit 5, and executes the selected driving method.

That is to say, if the predicted power consumption of the address driver 6 that is indicated by the predicted address power value WP is lower than a predetermined power, then the driving control circuit 20 supplies an address power curbing signal APC with the logic level "0" to the selector 36 of the data conversion circuit 30. Thus, the pixel driving data $GD_a$ shown in FIG. 4 are supplied to the memory 4, and the display panel is driven in accordance with FIG. 10 and FIG. 11, based on those pixel driving data $GD_a$. With this driving method, selective erasing discharges are repeatedly induced in the discharge cells within one field display period as shown by the black circles in FIG. 4, so that it becomes possible to reliably extinguish the wall charge in the discharge cells, and the deterioration of the display due to incomplete discharge can be prevented.

On the other hand, if the predicted power consumption of the address driver 6 that is indicated by the predicted address power value WP is higher than a predetermined power, then the driving control circuit 20 supplies an address power curbing signal APC with the logic level "1" to the selector 36 of the data conversion circuit 30. Thus, the pixel driving data $GD_b$ shown in FIG. 5 are supplied to the memory 4, and the display panel is driven in accordance with FIG. 10 and FIG. 11, based on those pixel driving data $GD_b$. With this driving method, the selective erasing discharge that is supposed to be induced in the discharge cells is limited to at most once per field display period, as indicated by the black circles in FIG. 5, so that the power consumption associated with this selective erasing discharge is restricted. In other words, the number of high-voltage pixel data pulses that are supposed to be applied during one field period to the column electrode D to be driven is decreased only for those pixel data pulse generation circuits 22 of the pixel data pulse generation circuits 22*a* to 22*d* in which there is a large loss of power. Consequently, the number of selective erasing discharges that are induced in response to applying the high-voltage pixel data pulses is reduced, and the generation of heat is restricted considerably. As a result, it becomes possible to mount the driver modules DM with the pixel data pulse generation circuits 22 partitioned into chips, as shown in FIG. 8, thus allowing for considerable cost reductions.

As noted above, in the plasma display device shown in FIG. 1, the predicted power consumption that is expected in the pixel data pulse generation circuits 22 is determined for each of the pixel data in one field corresponding to the input video signal, based on those pixel data. Then, based on that predicted power consumption, the number of times a high-voltage pixel data pulse is applied in that one field display period is changed for each display cell. In this situation, if the predicted power consumption is large, the number of selective erasing discharges can be reduced by reducing, for each of the discharge cells, the number of times high-voltage pixel data pulses are applied in that one field display period, thus curbing the power consumption of the address driver 6.

Here, the power consumption of the address driver 6 depends on the current that flows when the resonance pulse power source voltage is applied as the power source lines 2*a* to 2*d*. The resonance pulse power source voltage changes for example as shown in FIGS. 7A to 7C, in accordance with the application pattern of the pixel data pulses due to the pixel data pulse groups DP1, DP2, DP3, . . . , DP(n) applied to the column electrode D.

FIG. 7A is a diagram illustrating the pixel data pulses DP applied to the column electrode D and the resonance pulse power source voltage on the power source line 2 when the bit sequence of the pixel data bits DB corresponding to the first display line to the seventh display line in the i-th column (i=1 . . . m) of the PDP 10 is

[1,0,1,0,1,0,1]

FIG. 7B is a diagram illustrating the pixel data pulses DP applied to the column electrode D and the resonance pulse power source voltage on the power source line 2 when the bit sequence of the pixel data bits DB corresponding to the first display line to the seventh display line in the i-th column (i=1 . . . m) of the PDP 10 is

[1,1,1,1,1,1,1]

FIG. 7C is a diagram illustrating the pixel data pulses DP applied to the column electrode D and the resonance pulse power source voltage on the power source line 2 when the bit sequence of the pixel data bits DB corresponding to the first display line to the seventh display line in the i-th column (i=1 . . . m) of the PDP 10 is

[0,0,0,0,0,0,0]

First, if the bit sequence of the pixel data bits DB is inverted at each adjacent display line, as in the sequence [1, 0, 1, 0, 1, 0, 1], then the switching elements SZ1 to SZ0 of the pixel data pulse generation circuit 22 alternately transition between ON states and OFF states, as shown in FIG. 7A. In the driving step G1 of the first cycle CYC1 to the seventh cycle CYC7, only the switching element S1 of the switching elements S1 to S3 assumes the ON state, and the charge that has accumulated in the capacitor C1 is discharged. In FIG. 7A, the switching element SZ1 assumes the ON state in the first cycle CYC1, the third cycle CYC3, the fifth cycle CYC5 and the seventh cycle CYC7. Consequently, in these odd-numbered cycles CYC, the discharge current due to these discharges flows through the switching element S1, the coil L1, the diode DD1, the power source line 2 and the switching element SZ1 to the column electrode D of the PDP 10. Thus, the load capacitance $C_0$ of the column electrode D is charged, and a charge is accumulated in this load capacitance $C_0$. Then, due to resonance between the coil L1 and the load capacitance $C_0$, the voltage on the power source line 2 gradually increases with the discharge of the capacitor C1, and reaches the voltage Va, which is twice the voltage of the voltage Vc at the one end of the capacitor, as shown in FIG. 7A. In this situation, the smoothly rising voltage portion on the power source line 2 becomes the front edge portion of the resonance pulse power source voltage. It should be noted that in the first cycle CYC1, the third cycle CYC3, the fifth cycle CYC5 and the seventh cycle CYC7, the front edge portions of the above-described resonance pulse power source voltage directly become the front edge portions of the pixel data pulses $DP_{1i}$, $DP_{3i}$, $DP_{5i}$ and $DP_{7i}$ shown in FIG. 7A. Moreover, in the driving steps G2 of the first cycle CYC1 to the seventh cycle CYC7, only the switching element S3 of the switching elements S1 to S3 assumes the ON state, so that the DC voltage Va due to the DC power source is applied via the switching element S3 to the power source line 2. In this situation, the voltage Va becomes the maximum voltage portion of the resonance pulse power source voltage. It should be noted that in the first cycle CYC1, the third cycle CYC3, the fifth cycle CYC5 and the seventh cycle CYC7, the maximum voltage portion (voltage Va) of the resonance pulse power source voltage directly becomes the maximum voltage portion of the pixel data pulses $DP_{1i}$, $DP_{3i}$, $DP_{5i}$ and $DP_{7i}$ shown in FIG. 7A. In this situation, a current flows to the column electrode $D_i$ of the PDP 10, and charges the load capacitance CO of this column electrode $D_i$, accumulating charge. Furthermore, in the driving step G3 of the first cycle CYC1 to the seventh cycle CYC7, only the switching element S2 of the switching elements S1 to S3 assumes the ON state, and the discharge of the load capacitance $C_0$ of the PDP 10 begins. With this discharge, a current flows through the column electrode $D_i$, the switching element SZ1, the power source line 2, the coil L2, the diode DD2, and the switching element S2 into the capacitor C1. That is to say, the charge that has accumulated in the load capacitance $C_0$ of the PDP 10 is collected in the capacitor C1 formed in the resonance pulse power circuit 21. At this time, the voltage on the power source line 2 gradually decreases with a time constant that depends on the coil L2 and the load capacitance $C_0$, as shown in FIG. 7A. In this situation, the smoothly decreasing voltage portion on the power source line 2 becomes the rear edge portion of the resonance pulse power source voltage. It should be noted that in first cycle CYC1, the third cycle CYC3, the fifth cycle CYC5 and the seventh cycle CYC7, the rear edge portion of this resonance pulse power source voltage directly becomes the rear edge portion of the pixel data pulses $DP_{1i}$, $DP_{3i}$, $DP_{5i}$ and $DP_{7i}$ shown in FIG. 7A. Here, in the second cycle CYC2, the fourth cycle CYC4 and the sixth cycle CYC6 in FIG. 7A, the switching element SZ1 assumes the OFF state. Consequently, a low voltage (0 Volts) is applied to the column electrode $D_i$ as the pixel data pulses $DP_{2i}$, $DP_{4i}$ and $DP_{6i}$ corresponding to the second display line, the fourth display line and the sixth display line. Moreover, in these even-numbered cycles CYC, the switching element SZ0 assumes the ON state, so that the charge that has remained in the load capacitance $C_0$ of the PDP 10 is collected completely via the current path made of the column electrode $D_i$ and the switching element SZ0. Consequently, when for example the second cycle CYC2 terminates and the switching element SZ1 is switched from the OFF state to the ON state at the following third cycle CYC3, the voltage on the power source line 2 shown in FIG. 7A becomes substantially 0 Volt.

Thus, if a sequence of at least two bits of the pixel data bits DB for one column electrode D is inverted for each display line, as in the sequence [1, 0], then a resonance pulse power source voltage having a resonance amplitude $V_1$ at the maximum voltage Va is applied on the power source line 2, as shown in FIG. 7A.

On the other hand, if the bit sequence of the pixel data bits DB for one column electrode D is a series of logic level "1" as in the sequence [1, 1, 1, 1, 1, 1, 1], then the switching element SZ1 of the pixel data pulse generation circuit 22 is fixed to the ON state, and the switching element SZ0 is fixed to the OFF state, as shown in FIG. 7B. That is to say, during this time, different to the case in FIG. 7A, there is no charge collection due to the current path made of the column electrode $D_i$ and the switching element SZ0. Consequently, the charge that has not been collected at the driving step G3 of the cycles CYC gradually accumulates in the load capacitance $C_0$ of the PDP 10. As a result, while the resonance pulse power source voltage applied on the power source line 2 is sustained at the maximum voltage Va, the resonance amplitude $V_1$ gradually decreases and is applied directly as the high-voltage pixel data pulses $DP_{1i}$ to $DP_{7i}$ to the column electrode $D_i$, as shown in FIG. 7B.

Thus, if at least two consecutive data bits of the pixel data bits DB for one column electrode D both assume the logic level "1" then the resonance amplitude of the resonance pulse power source voltage becomes smaller while sustaining its maximum voltage Va, as shown in FIG. 7B, and is gradually turned into a DC voltage (that is, fixed to the voltage Va). As a result, the charge/discharge operation brought about by resonance is stopped, and reactive power can be limited.

Moreover, if the bit sequence of the pixel data bits DB for one column electrode D is a series of logic level "0" as in the sequence [0, 0, 0, 0, 0, 0, 0], then the switching element SZ1 is fixed to the OFF state, and the switching element SZ0 is fixed to the ON state, as shown in FIG. 7C. In this situation, in the driving steps G1 of the first cycle CYC1 to the seventh cycle CYC7, as in the case of FIG. 7A, the charge that has accumulated in the capacitor C1 is discharged. The voltage Vc that is generated at one end of the capacitor C1 in the course of the discharge is gradually increased, as shown in FIG. 7C, as a result of the resonance of the coil L1 and the parasitic capacitance $C_e$ of the power source line 2. Then, the ultimate voltage that is applied on the power source line 2 reaches the voltage Va which is twice that voltage Vc. In this situation, the smooth voltage increase portion on the power source line 2 becomes the front edge portion of the resonance pulse power source voltage. Next, in the driving steps G2 of the first cycle CYC1 to the seventh cycle CYC7, the voltage Va from the DC power source V1 is applied via the switching element S3 to the power source line 2. In this situation, a charge accumulates by charging the parasitic capacitance $C_e$ of the power source line 2. It should be noted that the voltage Va serves as the maximum voltage portion of the resonance pulse power source voltage. Then, when the driving step G3 is executed, this parasitic capacitance $C_e$ starts to discharge, and the charge that has accumulated on the parasitic capacitance $C_e$ is collected on the capacitor C1 that is formed in the resonance pulse power circuit 21. At this time, the voltage on the power source line 2 gradually decreases with a time constant that depends on the coil L2 and the parasitic capacitance $C_e$. However, the charge that could not be collected in the driving step G3 of the various cycles CYC is gradually accumulated in the parasitic capacitance $C_e$, so that while the resonance pulse power source voltage applied on the power source line 2 is sustained at the maximum voltage Va, the resonance amplitude $V_1$ gradually decreases.

Thus, also if at least two consecutive data bits in the bit sequence of the pixel data bit DB for one column electrode D both assume the logic level "0" then the amplitude of the resonance pulse power source voltage that is applied on the power source line 2 becomes gradually smaller, as shown in FIG. 7C, and is gradually turned into a DC voltage (that is, fixed to the voltage Va). Consequently, the above-described charge/discharge operation brought about by resonance is not executed anymore, and the reactive power can be limited.

As explained above, with the resonance pulse power circuit 21, the reactive power can be limited by changing the resonance amplitude of the resonance pulse power source voltage in accordance with the pattern of the pulse sequence due to the pixel data pulse, while sustaining the maximum voltage Va, as shown in FIG. 7A to FIG. 7C.

If the bit sequence of the pixel data bits DB for most of the column electrodes $D_1$ to $D_m$ is consecutively at the same logic level and the bit sequence of the pixel data bits DB for some of the column electrodes D is repeatedly logically inverted, then the address driver 6 gradually changes to DC driving as shown in FIG. 7B and FIG. 7C. Consequently, the switching elements SZ1, at which high-voltage pixel data pulses DP and low-voltage pixel data pulse DP are applied alternately for each display line to the row electrodes D, is DC driven, and consequently the power loss increases and the dissipated heat becomes large.

However, in the plasma display device shown in FIG. 1, if the predicted power consumption of the address driver 6 that has been determined with the address driver power prediction circuit 5 is larger than a predetermined power, then the number of high-voltage pixel data pulses to be applied within one field display period is decreased for each discharge cell. Thus, the power that is consumed in the course of the discharges can be reduced by an amount corresponding to the reduced number of selective erasing discharges that are induced by applying the high-voltage pixel data pulse, so that heat generation from the switching elements SZ1 can be suppressed.

It should be noted that this embodiment has been explained for the case that the method used to set the discharge cells in the addressing step Wc is the so-called selective erasing addressing method, in which a wall charge is formed in advance in all discharge cells, and this wall charge is selectively erased in accordance with the pixel data.

However, the present invention can similarly be applied to cases using the so-called selective writing addressing method, in which a wall charge is selectively formed in the discharge cells in accordance with the pixel data.

Figure 12:
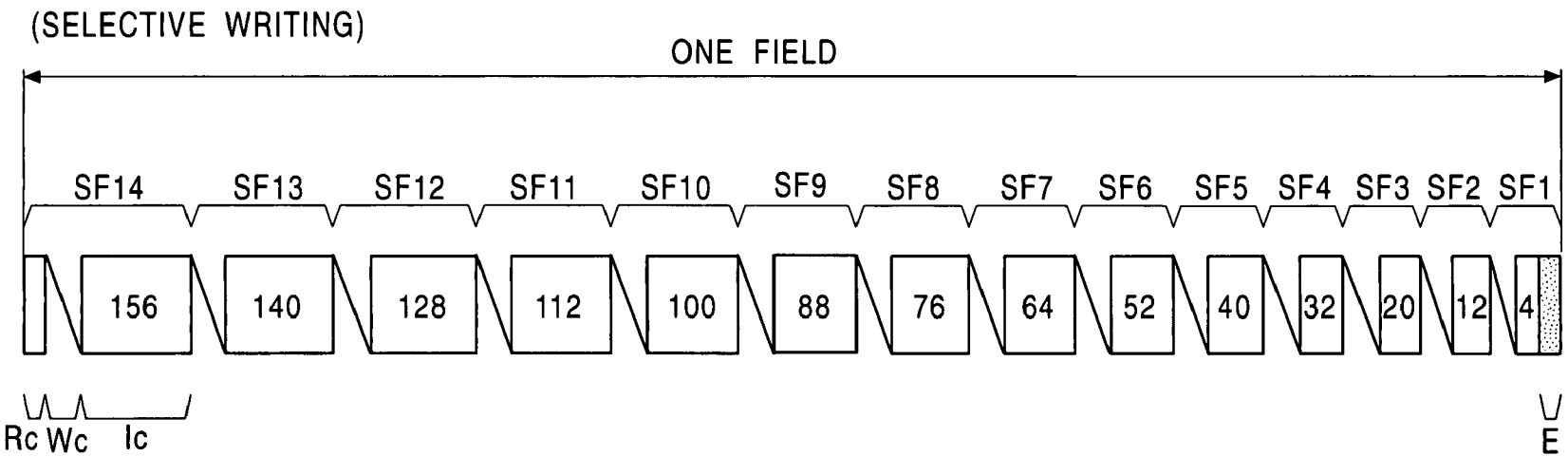
FIG. 12 is a diagram illustrating an example of the format of the light-emission driving that is used when driving the PDP 10 with the selective writing addressing method.

FIG. 12 is a diagram showing the emission driving format used in the driving control circuit 20 in the case that this selective writing addressing method is employed. Furthermore, FIG. 13 is a diagram showing a data conversion table used by the second data conversion circuit 34 in the case that this selective writing addressing method is employed, and an emission driving pattern based on the pixel driving data $GD_a$ obtained by this data conversion table. Furthermore, FIG. 14 is a diagram showing a data conversion table used by the second data conversion circuit 35 in the case that this selective writing addressing method is employed, and an emission driving pattern based on the pixel driving data $GD_b$ obtained by this data conversion table.

If the selective writing addressing method is employed, in the universal reset step Rc of the first sub-field SF 14 shown in FIG. 12, a reset discharge is induced for all discharge cells, and the wall discharge remaining in all discharge cells is extinguished. Then, in the addressing steps Wc of the sub-fields SF14 to SF1, the discharge cells are selectively discharged (selective writing discharge) based on the pixel driving data GD shown in FIGS. 13 or 14. In this situation, the wall charge is formed in those discharge cells in which a selective writing discharge is induced, and those discharge cells are set to the lighted cell state. On the other hand, in the discharge cells in which this selective writing discharge is not induced, no wall charge is formed, so that those discharge cells are set to the unlighted cell state. Then, in the emission sustain steps Ic of the sub-fields SF14 to SF1, only the discharge cells that are in the lighted cell state are repeatedly discharged (sustained discharge) for the number of times listed in FIG. 12, and the emission state is sustained with this sustained discharge.

In this situation, the driving control circuit 20 performs either the driving method shown in FIG. 13 or the driving method shown in FIG. 14, depending on the predicted address power value WP, which expresses the power consumption of the address driver 6 that is predicted by the address driver power prediction circuit 5.

First, if the predicted power consumption of the address driver 6 indicated by the predicted address power value WP is smaller than a predetermined power, then the driving control circuit 20 supplies an address power curbing signal APC of the logic level "0" to the selector 36 of the data conversion circuit 30. Thus, the pixel driving data $GD_a$ shown in FIG. 13 are supplied to the memory 4, and driving is performed in accordance with FIG. 12, based on those pixel driving data $GD_a$. That is to say, as indicated by the triangles in FIG. 13, selective writing discharges are induced in the addressing step Wc of those consecutive sub-fields that correspond to the luminance level to be expressed. Then, in the emission sustain steps Ic of the sub-fields indicated by the triangles in FIG. 13, sustained discharges are induced for a number of times that corresponds to the sub-fields. With this driving method, an intermediate luminance display with the fifteen gradations $$\{0, 1, 4, 9, 17, 27, 40, 56, 75, 97, 122, 150, 182, 217, 255\}$$

can be attained, in correspondence with the total number of sustained discharges that are performed within one field.

In this case, a wall charge is reliably formed in the discharge cells by repeatedly performing selective writing discharges within one field period as shown by the triangles in FIG. 13, so that display deterioration due to incomplete discharges can be inhibited.

On the other hand, if the present power consumption of the address driver 6 indicated by the predicted address power value WP is larger than a predetermined power, then the driving control circuit 20 supplies an address power curbing signal APC of the logic level "1" to the selector 36 of the data conversion circuit 30. Thus, the pixel driving data $GD_b$ shown in FIG. 14 are supplied to the memory 4, and driving is performed in accordance with FIG. 12, based on those pixel driving data $GD_b$. That is to say, as indicated by the black circles in FIG. 14, selective writing discharges are induced only once (or zero times) per field period. If the selective writing addressing method is employed, the step of erasing the wall charge in the discharge cells is only the universal reset step Rc of the first sub-field SF14 and the erasing step E of the last sub-field SF1. Thus, if the selective writing discharge is induced only once in the addressing step Wc of the sub-fields indicated by the black circles in FIG. 14, then the discharge cells can be maintained at the lighted cell state even if no selective writing discharge is induced in the addressing steps Wc of the subsequent sub-fields. Consequently, in the emission sustain step Ic of the sub-fields indicated by the black circles and the white circles in FIG. 14, sustain discharges are induced for a number times that corresponds to those sub-fields. With this driving method, an intermediate luminance display with the fifteen gradations

{0, 1, 4, 9, 17, 27, 40, 56, 75, 97, 122, 150, 182, 217, 255} can be attained, as in the case of FIG. 10, in correspondence with the total number of sustained discharges that are performed within one field.

However, in the driving method shown in FIG. 14, not more than selective writing discharge is executed within one field period, so that the power consumption due to this selective writing discharge is lower than in the driving method shown in FIG. 13.

In this embodiment, when the predicted power consumption of the address driver 6 becomes large, the number of selective erasing (or writing) discharges that are induced within one field period is set to not more than one, but there is no limitation to this. That is to say, it is sufficient if the number of selective erasing (or writing) discharges that are induced within one field period is reduced when the predicted power consumption of the address driver 6 becomes large.

Thus, instead of reducing the number of selective erasing (or writing) discharges that are induced within one field period, it is also possible to reduce the number of sub-fields.

Figures 15A, 15B:
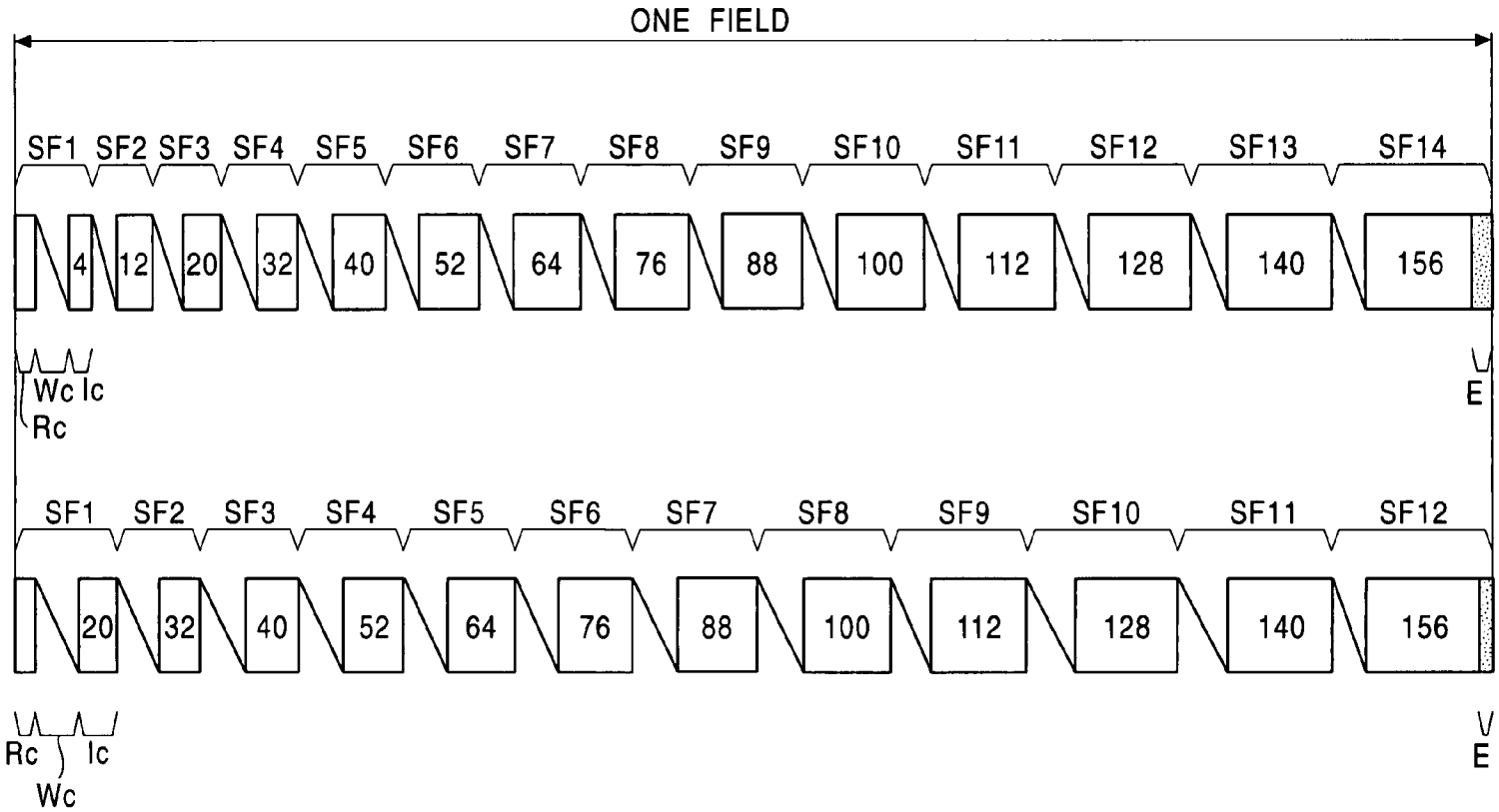
FIGS. 15A and 15B are diagrams illustrating an example of a light-emission driving pattern in accordance with another embodiment of the present invention.

FIGS. 15A and 15B are diagrams showing an example of an emission driving format that has been devised in consideration of this aspect.

When the predicted power consumption of the address driver 6 becomes smaller than a predetermined power, the driving control circuit 20 performs gradation driving with fourteen sub-fields SF1 to SF14 as shown in FIG. 15A. On the other hand, when the predicted power consumption of the address driver 6 becomes larger than a predetermined power, the driving control circuit 20 performs gradation driving with twelve sub-fields SF1 to SF12 as shown in FIG. 15B. Consequently, when the predicted power consumption of the address driver 6 becomes relatively large, the number of sub-fields is reduced from fourteen to twelve, so that the number of selective discharges induced in the addressing step Wc is reduced correspondingly. Consequently, the number of selective discharges induced within one field is reduced, so that the power consumption of the address driver 6 due to these selective discharges is decreased.

Furthermore, in this embodiment, the number of selective discharges that are performed within one field period is switched between two levels, namely the scenario in FIG. 4 (FIG. 13) and the scenario in FIG. 5 (FIG. 14), in accordance with the current power consumption of the address driver 6, but there is not limitation to this. That is to say, it is also possible that the number of selective discharges that are performed within one field period is switched between three or more levels, in accordance with the predicted power consumption of the address driver 6.

Figure 16:
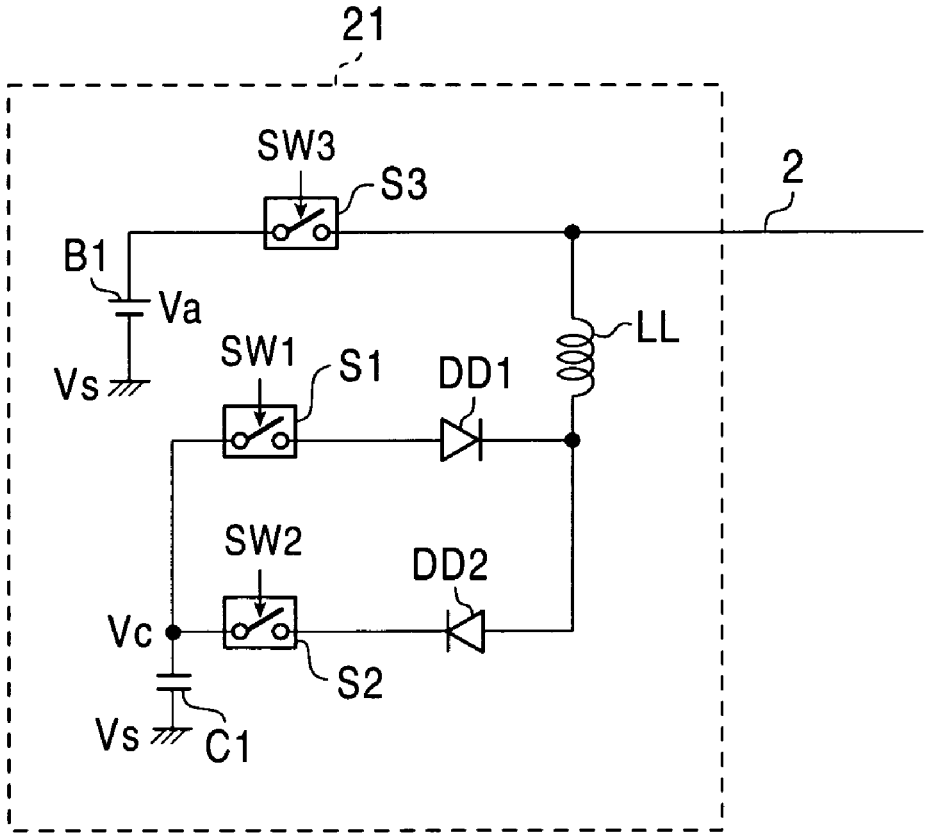
FIG. 16 is a diagram illustrating another configuration of the resonance pulse power circuit 21.

Furthermore, in the resonance pulse power circuit 21 shown in FIG. 6, coils are provided separately in the discharge current path made of the switching element S1, the coil L1 and the diode DD1 and the charge current path made of the coil L2, the diode DD2 and the switching element S2, but as shown in FIG. 16, it is also possible that a single coil (LL) is shared by the discharge current path and the charge current path.

Furthermore, in this embodiment, driver modules DM, on which a pixel data pulse generation circuit 22 is integrated into an IC chip, are provided on flexible cables FL, but it is also possible to adopt a configuration in which the driver modules DM are directly mounted onto a peripheral portion of the rear substrate 100, and are connected to a column electrode lead line and a power source line.

This application is based on a Japanese patent application No. 2002-188286, and the entire disclosure thereof is incorporated herein by reference.

What is claimed is:

1. A display panel driver for driving a display panel in which capacitive light emitting cells serving as pixels are formed at intersections between a plurality of row electrodes serving as display lines and a plurality of column electrodes intersecting with said row electrodes in accordance with pixel data for the pixels based on an input video signal, the display panel driver comprising:

a pixel data pulse generation circuit which generates pixel data pulses by connecting said column electrodes and a power source line in accordance with said pixel data to apply said pixel data pulses to said column electrodes;

a resonance pulse power circuit which generates a resonance pulse power source voltage to apply said resonance pulse power source voltage to said power source line, said resonance pulse power circuit changing the resonance amplitude of said resonance pulse power source voltage while keeping a maximum voltage of said resonance pulse power source voltage in accordance with a pattern of a pulse sequence of said pixel data pulses;

a power prediction circuit which determines a predicted power consumption of said resonance pulse power circuit based on said pixel data for one field; and a power consumption control circuit which controls said pixel data pulse generation circuit so as to adjust the power consumption of said resonance pulse power circuit in accordance with said predicted power consumption.

2. The display panel driver in accordance with claim 1, wherein said power prediction circuit determines, as said predicted power consumption, the root mean square of the resonance driving power when said resonance pulse power circuit is in resonance operation and the DC driving power when said resonance pulse power circuit is in DC operation.

3. The display panel driver in accordance with claim 1, wherein said power consumption control circuit controls said pixel data pulse generation circuit such that the number of times said pixel data pulses are applied within one field period is changed in accordance with said predicted power consumption.

4. The display panel driver in accordance with claim 1, wherein said power consumption control circuit controls said pixel data pulse generation circuit such that the number of pixel data pulses that are applied is smaller when said predicted consumption power is large than when said predicted consumption power is small.

5. The display panel driver in accordance with claim 1, wherein said pixel data pulse generation circuit is divided into a plurality of IC chips respectively corresponding to column electrode groups that are made of a predetermined number of column electrodes;

said power prediction circuit determines said predicted power consumption individually for each of said IC chips; and said power consumption control circuit controls the number of times that the pixel data pulses are applied within one field period individually for each of said IC chips based on said predicted power consumption for each of the chips.

6. The display panel driver in accordance with claim 5, wherein said power consumption control circuit performs the control such that the number of pixel data pulses that are applied is reduced only for those pixel data pulse generation circuits in which said predicted power consumption is large.

7. The display panel driver in accordance with claim 1, wherein, if at least two consecutive pixel data pulses that are applied to one of the row electrodes have the same voltage, then said resonance pulse power circuit reduces said resonance amplitude while sustaining said maximum voltage.

8. The display panel driver in accordance with claim 1, wherein said resonance pulse power circuit comprises:

a capacitor, one end of which is connected to ground;

a first current path made of a first switching element and a first coil that are arranged in series between the other end of said capacitor and said power source line;

a second current path made of a second switching element and a second coil that are arranged in series between the other end of said capacitor and said power source line;

a DC power source for generating said maximum voltage; and a third switching element provided between the DC power source and said power source line;

and wherein said pixel data pulse generation circuit comprises:

a plurality of fourth switching elements which provide a connection between said power source line and said column electrodes in response to the logic level of said pixel data; and a plurality of fifth switching elements which connect said column electrodes to ground in response to an inverted value of the logic level of said pixel data.

9. The display panel driver in accordance with claim 1, wherein said resonance pulse power circuit comprises drive control means that periodically repeat a control in which first only said first switching element is set to the ON state, then only said third switching element is set to the ON state, and then only said second switching element is set to the ON state.

10. A display panel driver for driving a display panel in which capacitive light emitting cells serving as pixels are formed at intersections between a plurality of row electrodes serving as display lines and a plurality of column electrodes intersecting with said row electrodes in accordance with pixel data for the pixels based on an input video signal, the display panel driver comprising:

a pixel data pulse generation circuit which generates pixel data pulses by connecting said column electrodes and a power source line in accordance with said pixel data to apply said pixel data pulses to said column electrodes;

a resonance pulse power circuit which generates a resonance pulse power source voltage to apply said resonance pulse power source voltage to said power source line, said resonance pulse power circuit changing the resonance amplitude of said resonance pulse power source voltage while keeping a maximum voltage of said resonance pulse power source voltage in accordance with a pattern of a pulse sequence of said pixel data pulses;

a power prediction circuit which determines a predicted power consumption of the resonance pulse power circuit based on said pixel data for one field; and a power consumption control circuit which controls said pixel data pulse generation circuit so as to adjust the power consumption of said resonance pulse power circuit in accordance with said predicted power consumption;

wherein said pixel data pulse generation circuit is divided into a plurality of IC chips respectively corresponding to column electrode groups that are made of a predetermined number of column electrodes; and wherein said IC chips are mounted on a plurality of flexible wiring boards that are respectively connected to said power source line and the column electrodes in said resonance pulse power circuit formed on the substrate of the display panel.

* * * * *